US007607747B2

(12) United States Patent
Tanaka et al.

(10) Patent No.: US 7,607,747 B2
(45) Date of Patent: Oct. 27, 2009

(54) PRINTING DEVICE, PRINTING DEVICE CONTROL PROGRAM, PRINTING DEVICE CONTROL METHOD, PRINTING DATA PRODUCING DEVICE, PRINTING DATA PRODUCING PROGRAM, PRINTING DATA PRODUCING METHOD, CORRECTION INFORMATION PRODUCING METHOD, AND CORRECTION INFORMATION PRODUCING DEVICE

(75) Inventors: Toshio Tanaka, Shiojiri (JP); Hitoshi Yamakado, Hinu (JP)

(73) Assignee: Seiko Epson Corporation (JP)

( * ) Notice: Subject to any disclaimer, the term of this patent is extended or adjusted under 35 U.S.C. 154(b) by 300 days.

(21) Appl. No.: 11/359,905

(22) Filed: Feb. 22, 2006

(65) Prior Publication Data

US 2006/0188308 A1 Aug. 24, 2006

(30) Foreign Application Priority Data

Feb. 24, 2005 (JP) ..... 2005-048620
Nov. 9, 2005 (JP) ..... 2005-324853

(51) Int. Cl.
*B41J 29/38* (2006.01)

(52) U.S. Cl. ..... 347/12; 347/13

(58) Field of Classification Search ..... 347/15, 347/19, 12, 13, 40–43; 358/1.9
See application file for complete search history.

(56) References Cited

U.S. PATENT DOCUMENTS 6,283,571 B1 9/2001 Zhou et al.
6,293,643 B1 9/2001 Shimada et al.
6,328,404 B1 12/2001 Fujimori
6,843,610 B2 * 1/2005 Ioka et al. ..... 400/76
7,125,094 B2 * 10/2006 Mizes ..... 347/19
2004/0150693 A1 * 8/2004 Kojima et al. ..... 347/40
2004/0160470 A1 * 8/2004 Billow et al. ..... 347/19
2004/0160476 A1 * 8/2004 Khalid ..... 347/42

FOREIGN PATENT DOCUMENTS

JP 01-129667 5/1989
JP 01-235655 9/1989
JP 03-162977 7/1991
JP 11-151821 8/1999
JP 11-254662 9/1999
JP 2000-79710 3/2000
JP 2000-190470 7/2000
JP 2000-225716 8/2000

* cited by examiner

*Primary Examiner*—Matthew Luu
*Assistant Examiner*—Justin Seo
(74) *Attorney, Agent, or Firm*—Harness, Dickey & Pierce, P.L.C.

(57) ABSTRACT

A printing device includes a printing head having arranged printing elements capable of forming dots on a medium used for printing. The printing device prints an image by forming dots on the medium by the printing head. The printing device includes a printing control unit that controls the printing processing so that a line graph representing the density change characteristic of a printing result by the printing head draws a line with a gradient.

3 Claims, 12 Drawing Sheets

CORRECTION INFORMATION TABLE

CYAN HEAD UNIT

TARGET CHARACTERISTIC FUNCTION = LINEAR FUNCTION

| DENSITY VALUE/ NOZZLE NUMBER | 1 | 2 | 3 | 4 | ・・・ |
|---|---|---|---|---|---|
| 0～5 | 1.2 | 1.3 | 1.4 | 1.1 | ・・・ |
| 6～10 | 1.4 | 1.5 | 1.6 | 1.1 | ・・・ |
| 11～15 | 1.1 | 1.2 | 1.3 | 1.3 | ・・・ |
| 16～20 | 1.5 | 1.6 | 1.7 | 1.4 | ・・・ |
| ・・・ | ・・・ | ・・・ | ・・・ | ・・・ | ・・・ |
| 251～255 | 1.3 | 1.4 | 1.5 | 1.3 | ・・・ |

PRINTING DEVICE, PRINTING DEVICE CONTROL PROGRAM, PRINTING DEVICE CONTROL METHOD, PRINTING DATA PRODUCING DEVICE, PRINTING DATA PRODUCING PROGRAM, PRINTING DATA PRODUCING METHOD, CORRECTION INFORMATION PRODUCING METHOD, AND CORRECTION INFORMATION PRODUCING DEVICE

REALTED APPLICATIONS

This application claims priority to Japanese Patent Application Nos. 2005-048620 filed Feb. 24, 2005 and 2005-324853 filed Nov. 9, 2005 which are hereby expressly incorporated by reference herein in their entirety.

BACKGROUND

1. Technical Field

The present invention relates to a printing device such as an inkjet printing device, a printing device control program, a printing device control method, a printing data producing device, a printing data producing program, a printing data producing method, a correction information producing method, and correction information producing device. The invention more particularly relates to a printing device, a printing device control program, a printing device control method, a printing data producing device, a printing data producing program, a printing data producing method, a correction information producing method, and a correction information producing device that are suitable for reducing degradation in printing quality caused by density variations attributable to the printing head.

2. Related Art

It has been difficult to manufacture printing elements such as nozzles for an inkjet printing device and heating elements for a sublimation type printing device with equal precision, and therefore the printing elements have unequal characteristics. The characteristics variations cause the amount of ink discharged from the nozzles and the ink arriving positions to vary, which generates so-called density variations including high and low density parts in a resulting printed image such as an image originally intended to be a solid image with equal density.

For example, JP-A-1-129667 and JP-A-3-162977 disclose an image forming device and an image recording device respectively as techniques for correcting the density variations and improving the printing quality.

The image forming device disclosed by JP-A-1-129667 corrects image data based on a density variation correction table in order to address density variations by a printing element.

The image recording device disclosed by JP-A-3-162977 corrects image data based on a density variation correction table in order to address density variations by a printing element, and also corrects image data based on a gradation correction table for each prescribed unit (each printing element at least), so that density variations in any gradation ranges can be restricted.

However, in the disclosure of JP-A-1-129667 and JP-A-3-162977, the correction is carried out so that the density variation characteristics of dots formed by the printing elements in each printing head attain a flat state. More specifically, the correction is carried out in order to prevent density variations by each printing head, and therefore at a joining part between printing heads in a multi-head type printing device, in particular, the flat characteristics are joined with each other, so that the density changes in a stepped manner as shown in FIG. 14 in the event that the characteristics are even slightly shifted from each other. At such a joining part, the density variations in the printing result are more noticeable than restricted.

SUMMARY

Therefore, an advantage of some aspects of the invention is to provide a printing device, a printing device control program, a printing device control method, a printing data producing device, a printing data producing program, a printing data producing method, a correction information producing method, and a correction information producing device that are suitable for reducing degradation in printing quality caused by density variations attributable to the printing head.

A printing device according to a first aspect of the invention including a printing head having arranged printing elements capable of forming dots on a medium used for printing prints an image by forming dots on the medium by the printing head. The printing device includes a printing control unit that controls the printing processing so that a line graph representing the density change characteristic of a printing result by the printing head draws a line with a gradient.

In this way, the printing processing can be controlled using the printing control unit so that a line graph representing the density change characteristic of a printing result by the printing head draws a line with a gradient.

Therefore, when each of the printing elements is a nozzle for example, the amount of ink discharged from each nozzle can be controlled so that a line graph representing the density change characteristic of a printing result by the printing head draws a line with a gradient. Therefore, the density can be controlled to change continuously and gradually, and quality degradation caused by density variations attributable to the printing head can be less perceptible.

When correction is carried out so that the density change characteristic attains a flat state as with the conventional technique, the density can be reproduced only within the density range that can be reproduced by all the nozzles, which narrows the density reproducing range. According to the invention, correction is carried out so that a line with a gradient is drawn, and therefore the density reproducing range increases by the amount corresponding to the change because of the gradient. That is, the advantage that the density reproducing range increases as compared with the conventional technique is obtained.

Herein, the term "dot" refers to a single region formed by ink discharged from one or more nozzles and arriving on a printing medium. It is understood that the "dot" has a certain area rather than "zero" and there are a plurality of kinds of dots depending on the size. Note however that dots formed by discharged ink do not always form a perfect circle. When for example dots are formed in a shape other than a perfect circle such as an ellipse, the average diameter is treated as the dot size, or an equivalent perfect circle dot having an area equal to the area of a dot formed by a certain amount of discharged ink is assumed, and the diameter of the equivalent dot is sometimes treated as the dot size. Dots having the same size and different densities may be formed, dots having the same density and different ink discharge amounts may be formed or the density may be changed by forming dots on one another. When an ink droplet discharged from one nozzle separately arrives, the formed dot is counted as a dot. When two or more dots discharged from two nozzles or sequentially one after another from one nozzle are joined, the formed dots are counted as two dots. The same applies to the following description about a fourth aspect and on about a printing device, a printing device control program, a printing device control method, a printing data producing device, a printing data producing program, a printing data producing method, a correction information producing method, a correction information producing device, and a storage medium storing the program, and the description in DESCRIPTION OF EXEMPLARY EMBODIMENTS.

The line with a gradient described above includes a line other than a flat straight line with no gradient, while the gradient is preferably mild with no sharp change (such as the degree of gradient that is not more than $\sqrt{2}$ wherein the minimum density value is 80% of the maximum density value). The same applies to the following description about the aspects regarding the printing device control program, the printing device control method, the printing data producing device, the printing data producing program, the printing data producing method, the correction information producing method, the correction information producing device, and the storage medium storing the program, and the description in DESCRIPTION OF EXEMPLARY EMBODIMENTS.

The density change characteristic refers to change in the density value of dots formed by each of printing elements forming a printing head for pixel data having the same pixel value. For example, in a single head, line head type printing device, the density change characteristic can be expressed by a line graph representing the change characteristic of the density value of each nozzle such as a line graph formed by linearly interpolating points corresponding to density values (or change amounts) when the abscissa represents the number of each printing element corresponding to the place in the arrangement order of printing elements and the ordinate represents the density value of dots (or a change amount relative to a target value of the density) formed by a printing element having a corresponding number. With a multi-pass printing head, a printing element with the same number is used for a plurality of pieces of pixel data in the same line, and therefore a plurality of points are present on a line for the printing element having the same number when the abscissa represents the arrangement order of the printing elements as described above. The same applies to the following description about the aspects regarding the printing device, the printing device control program, the printing device control method, the printing data producing device, the printing data producing program, the printing data producing method, the correction information producing method, the correction information producing device, and the storage medium storing the program, and the description in DESCRIPTION OF EXEMPLARY EMBODIMENTS.

The printing control unit controls printing processing by correcting printing data as software so that a line graph representing the density change characteristic of a printing head draws a line with a gradient. Alternatively, the unit controls printing processing by correcting a signal produced from normal printing data for example by correcting the level of voltage to be applied to a piezo actuator as hardware such as an electric circuit. The same applies to the following description about the aspects regarding the printing device control program (printing control in this section) and the printing device control method (printing control in this section) and the description in DESCRIPTION OF EXEMPLARY EMBODIMENTS As an actual example of the printing device, a printing device, printing machine, a combination of a printing device or a printing machine with a printing device controller (such as a controller PC externally attached to the printing device), or a combination of a printing device or a printing machine with a PC may be employed. The same applies to the following description about the aspects regarding the printing device, the printing device control program, the printing device control method, the printing data producing device, the printing data producing program, the printing data producing method, the correction information producing method, the correction information producing device, and the storage medium storing the program, and the description in DESCRIPTION OF EXEMPLARY EMBODIMENTS.

In the printing device according to the first aspect, a printing device according to a second aspect of the invention further includes a plurality of such printing heads. Printing elements corresponding to pixel data having the same value exist among the plurality of printing heads, and the printing data producing unit controls the printing processing so that a line graph representing the density change characteristic of a printing result by the plurality of printing heads draws a line with a gradient.

In this way, a line graph representing the density change characteristic of a printing result by the printing elements existing among the plurality of printing heads draws a line with a gradient. Therefore, at a joining part between heads, the density of dots formed by each of the printing elements changes along the gradient. Therefore, the density of dots formed by each of the printing elements changes with a gradual gradient, so that density variations in a printing result generated at the joining part between the heads can be less perceptible.

In the printing device according to the first or second aspect, in a printing device according to a third aspect of the invention, the line with a gradient is at least one of a curved line and a straight line with a gradient.

In this way, the printing processing can be controlled so that the density change characteristic draws a mild curve such as a curve forming an ellipse, or for example a straight line having a mild gradient. Therefore, quality degradation generated by density variations attributable to the printing head can be less perceptible.

Meanwhile, a printing device according to a fourth aspect of the invention includes a printing head having arranged printing elements capable of forming dots on a medium used for printing. The printing device prints an image by forming dots on the medium by the printing head. The printing device includes an image data obtaining unit that obtains image data including pixel data corresponding to a plurality of pixels forming the image, a correction information storage that stores correction information produced based on the density change of dots formed by the printing head for pixel data having the same value in the arrangement direction of the printing elements and used for correcting the density change characteristic of each of the printing elements, a printing data producing unit that produces printing data that defines information related to a dot forming content by each of the printing elements corresponding to the image data, and a printing unit that prints the image on the medium by the printing head based on the printing data.

The printing data producing unit produces printing data based on the image data and the correction information so that a line graph representing the density change characteristic of a printing result by the printing head draws a line with a gradient.

In this way, image data including pixel data corresponding to a plurality of pixels forming the image can be obtained by the image data obtaining unit. The correction information produced based on the density change of dots formed by the printing head for pixel data having the same value in the arrangement direction of the printing elements and used for correcting the density change characteristic of each of the printing elements can be stored by the correction information storage. Printing data that defines information related to a dot forming content by each of the printing elements corresponding to the image data can be produced by the printing data producing unit. The image can be printed on the medium based on the printing data by the printing head.

The printing data producing unit can produce printing data based on the image data and the correction information so that a line graph representing the density change characteristic of a printing result by the printing head draws a line with a gradient.

Therefore, when each of the printing elements is a nozzle for example, produced printing data allows printing control to be carried out so that the amount of ink discharged from each nozzle can be controlled so that a line graph representing the density change characteristic of a printing result by the printing head draws a line with a gradient. Therefore, produced printing data allows the density to be controlled to change continuously and gradually, and quality degradation caused by density variations attributable to the printing head can be less perceptible.

Herein, the image data obtaining unit obtains image data input by an optical printing result reader such as a scanner, passively or actively obtains image data stored in an external device through a network such as a LAN and a WAN, obtains image data from a storage medium such as a CD-ROM and a DVD-ROM through a drive such as a CD drive and a DVD drive in the printing device, or obtains image data stored in a storage in the printing device. More specifically, the term "obtaining" includes at least inputting, acquiring, receiving, and reading. The same applies to the following description about the aspects regarding the printing device control program (image data obtaining in this section), the printing device control method (image data obtaining in this section), and the printing data producing device, and the description in DESCRIPTION OF EXEMPLARY EMBODIMENTS.

The correction information storage may store correction information used for correcting the density change characteristic by any means and at any time, may store such correction information in advance, or may be adapted to store such correction information in response to an external input during the operation of the printing device rather than storing the correction information in advance. For example, before the printing device is marketed as a product such as at the time of shipment from the factory, the printing density of the printing elements forming the printing head may be detected from a printing result by the printing head using an optical printing result reader such as a scanner, and correction information may be produced based on the detection result and previously stored. Alternatively, the printing density of the printing elements forming the printing head may be detected during using the printing device similarly to the occasion of the shipment from the factory, and correction information may be produced based on the detection result and stored. The information may be stored in any timing as long as it is in a stored state when the product is used. In order to address change in the characteristic of the printing head after the printing device is used, the printing density of the printing elements forming the printing head may be detected regularly or in prescribed timing using an optical printing result reader such as a scanner based on a printing result by the printing head, and correction information may be produced based on the detection result and stored together with or written over the data at the time of shipment from the factory, so that the correction information may be updated. The same applies to the following description about the aspect regarding the printing data producing device and the description in DESCRIPTION OF EXEMPLARY EMBODIMENTS The information related to a dot forming content by the nozzle includes information necessary for forming dots by the nozzle for each pixel value in the image data such as information related to the presence/absence of dots (whether or not to form a dot by the nozzle) and information related to the size of dots if any (for example any of three sizes, large, medium, and small). If for example only one forming size is available, the information may include only the information related to the presence/absence of dots. Alternatively, information related to a dot forming content by the nozzle is information representing dots to be formed by the nozzle for each pixel value in image data, and actually a dot may be formed by a plurality of dots. The same applies to the following description about the aspect regarding the printing data producing device and the description in DESCRIPTION OF EXEMPLARY EMBODIMENTS. The same also applies to the following description about the aspects regarding the printing device control program, the printing device control method, the printing data producing device, the printing data producing program, the printing data producing method, and the storage medium storing the program, and the description in DESCRIPTION OF EXEMPLARY EMBODIMENTS.

The above described "definition" refers to forming information related to a dot forming content by the nozzle in a data format that can be interpreted by the printing device. The same applies to the following description about the aspects regarding the printing device control program, the printing device control method, the printing data producing device, the printing data producing program, the printing data producing method, and the storage medium storing the program, and the description in DESCRIPTION OF EXEMPLARY EMBODIMENTS.

A printing device according to a fifth aspect of the invention further includes a plurality of such printing heads in the printing device according to the fourth aspect. Printing elements corresponding to pixel data having the same value exist among the plurality of printing heads, and the printing data producing unit produces such printing data that a line graph representing the density change characteristic of a printing result by the plurality of printing heads draws a line with a gradient.

In this way, printing data can be produced so that a line graph representing the density change characteristic of a printing result by the printing elements existing among the plurality of heads draws a line with a gradient. Therefore, the density of dots formed by each of printing elements changes along the gradient at a joining part between heads, and therefore, printing data that allows the density of dots formed by the printing elements to change along a mild gradient at joining parts between heads can be produced, so that density variations on a printing result generated at the joining parts between the printing heads can be less perceptible.

In a printing device according to a sixth aspect of the invention in the printing device according to the fourth or fifth aspect, the correction information includes information on a continuous function that forms a line with a gradient.

In this way, a density value output (printed) in response to a certain input value may be measured, and change in the density value may be approximated by a continuous function, so that printing data can readily be produced so that a line graph representing the density change characteristic draws a target gradient line.

In a printing device according to a seventh aspect of the invention in the printing device according to any one of the fourth to sixth aspects, the line with a gradient is at least one of a curve and a straight line having a gradient.

In this way, printing data can be produced so that a line graph representing the density change characteristic draws a mild curve such as a curve forming an ellipse or for example a straight line having a mild gradient. Therefore, quality degradation generated by density variations attributable to the printing head can be less perceptible.

Meanwhile, a printing device control program according to an eighth aspect of the invention is used for controlling a printing device including a printing head having arranged printing elements capable of forming dots on a medium used for printing. The printing device prints an image by forming dots on the medium by the printing head. The program includes a program enabling a computer to carry out such printing control that a line graph representing the density change characteristic of a printing result by the printing head draws a line with a gradient.

In this way, when the program is read by the computer and the computer carries out the processing according to the read program, the function and advantage the same as those of the printing device according to the first aspect are provided.

According to a printing control program according to a ninth aspect of the invention in the program according to the eighth aspect, the printing device further includes a plurality of such printing heads, printing elements corresponding to pixel data having the same value exist among the plurality of printing heads, and in the printing data producing, the printing processing is controlled so that a line graph representing the density change characteristic of a printing result by the plurality of printing heads draws a line with a gradient.

In this way, when the program is read by the computer and the computer carries out the processing according to the read program, the function and advantage the same as those of the printing device according to the second aspect are provided.

According to a printing device control program according to a tenth aspect of the invention in the program according to the eighth or ninth aspect, the line with a gradient is at least one of a curve and a straight line having a gradient.

In this way, when the program is read by the computer and the computer carries out the processing according to the read program, the function and advantage the same as those of the printing device according to the third aspect are provided.

Meanwhile, a printing device control program according to an eleventh aspect of the invention is used for controlling a printing device including a printing head having continuously arranged printing elements capable of forming dots on a medium used for printing. The printing device prints an image by forming dots on the medium by the printing head. The program includes a program to enable a computer to carry out processing including obtaining image data including pixel data corresponding to a plurality of pixels forming the image, producing printing data that defines information related to a dot forming content by each printing element corresponding to the image data, and printing the image on the medium based on the printing data by the printing head. In the printing data producing, the printing data is produced based on the image data and correction information produced based on the density change of dots formed by the printing head for pixel data having the same value in the arrangement direction of the printing elements and used for correcting the density change characteristic of each printing element so that a line graph representing the density change characteristic of a printing result by the printing head draws a line with a gradient.

In this way, when the program is read by the computer and the computer carries out the processing according to the read program, the function and advantage the same as those of the printing device according to the fourth aspect are provided.

According to a printing device control program according to a twelfth aspect of the invention in the program according to the eleventh aspect, the printing device further includes a plurality of such printing heads, and printing elements corresponding to pixel data having the same value exist among the plurality of printing heads. In the printing data producing, the printing processing is controlled so that a line graph representing the density change characteristic of a printing result by the plurality of printing heads draws a line with a gradient.

In this way, when the program is read by the computer and the computer carries out the processing according to the read program, the function and advantage the same as those of the printing device according to the fifth aspect are provided.

According to a printing device control program according to a thirteenth aspect of the invention in the program according to the eleventh or twelfth aspect, the correction information includes information on a continuous function that forms a line with a gradient.

In this way, when the program is read by the computer and the computer carries out the processing according to the read program, the function and advantage the same as those of the printing device according to the sixth aspect are provided.

According to a printing device control program according to a fourteenth aspect of the invention in the program according to any one of the eleventh to thirteen aspects, the line with a gradient is at least one of a curve and a straight line having a gradient.

In this way, when the program is read by the computer and the computer carries out the processing according to the read program, the function and advantage the same as those of the printing device according to the seventh aspect are provided.

Meanwhile, a computer-readable storage medium storing a printing device control program according to a fifteenth aspect of the invention is a computer-readable storage medium storing a printing device control program according to any one of the eighth to tenth aspects.

In this way, the function and advantage the same as those of the printing device control program according to any one of the eighth to tenth aspect of the inventions are provided, and the printing program may readily be exchanged through a storage medium such as a CD-ROM, a DVD-ROM, and an MO.

A computer-readable storage medium storing a printing device control program according to a sixteenth aspect of the invention is a computer-readable storage medium storing a printing device control program according to any one of the eleventh to fourteenth aspects.

In this way, the function and advantage the same as those of the printing device control program according to any one of the eleventh to fourteenth aspects are provided, and the printing program may readily be exchanged through a storage medium such as a CD-ROM, a DVD-ROM, and an MO.

Meanwhile, a method of controlling a printing device according to a seventeenth aspect of the invention is used to control a printing device including a printing head having arranged printing elements capable of forming dots on a medium used for printing. The printing device prints an image by forming dots on the printing medium by the printing head. The method includes such printing control that a line graph representing the density change characteristic of a printing result by the printing head draws a line with a gradient.

in this way, the function and advantage the same as those of the printing device according to the first aspect can be provided.

According to a method of controlling a printing device according to an eighteenth aspect of the invention in the method according to the seventeenth aspect, the printing device further includes a plurality of such printing heads and printing elements corresponding to pixel data having the same value exist among the plurality of printing heads. In the printing data producing, the printing processing is controlled so that a line graph representing the density change characteristic of a printing result by the plurality of printing heads draws a line with a gradient.

In this way, the function and advantage the same as those of the printing device according to the second aspect can be provided.

According to a method of controlling a printing device according to a nineteenth aspect of the invention in the method according to the seventeenth or eighteenth aspect, the line with a gradient is at least one of a curve and a straight line having a gradient.

In this way, the function and advantage the same as those of the printing device according to the third aspect can be provided.

A method of controlling a printing device according to a twentieth aspect of the invention controls a printing device including a printing head having arranged printing elements capable of forming dots on a medium used for printing. The printing device prints an image by forming dots on the medium by the printing head. The method includes obtaining image data including pixel data corresponding to a plurality of pixels forming the image, producing printing data that defines information related to a dot forming content by each printing element corresponding to the image data, and printing the image on the medium by the printing head based on the printing data.

In the printing data producing, the printing data is produced based on the image data and correction information produced based on the density change of dots formed by the printing head for pixel data having the same value in the arrangement direction of the printing elements and used for correcting the density change characteristic of each printing element so that a line graph representing the density change characteristic of a printing result by the printing head draws a line with a gradient.

In this way, the function and advantage the same as those of the printing device according to the fourth aspect can be provided.

More specifically, in the image data obtaining, when a program stored in a storage medium such as a ROM is loaded to a RAM, and the CPU carries out the loaded program, an input device such as a scanner, a storage such as an HDD, an input/output interface I/F, and the like cooperate with one another to carry out the processing. The printing data producing is carried out when a program stored in a storage such as a ROM is loaded to a RAM, the CPU carries out the loaded program, and various kinds of data such as correction information stored in the storage are used to carry out the processing. The printing processing is carried out when a program stored in a storage medium such as a ROM is loaded to a RAM, the CPU carries out the loaded program, and a control signal is input to an output device including a printing head and a driving mechanism such as a paper feed mechanism to control the output device (printing unit).

In a preferable sequence of processing, the image data obtaining is carried out first, followed by the printing data producing, and then the printing.

According to a method of controlling a printing device according to a twenty-first aspect of the invention in the method according to the twentieth aspect, the printing device further includes a plurality of such printing heads, and printing elements corresponding to pixel data having the same value exist among the plurality of printing heads. In the printing data producing, the printing processing is controlled so that a line graph representing the density change characteristic of a printing result by the plurality of printing heads draws a line with a gradient.

In this way, the function and advantage the same as those of the printing device according to the fifth aspect can be provided.

According to a method of controlling a printing device according to a twenty-second aspect of the invention in the method according to the twentieth or twenty-first aspect, the correction information includes information on a continuous function that forms a line with a gradient.

In this way, the function and advantage the same as those of the printing device according to the sixth aspect can be provided.

According to a method of controlling a printing device according to a twenty-third aspect of the invention in the method according to any one of the twentieth to twenty-second aspects, the line with a gradient is at least one of a curve and a straight line having a gradient.

In this way, the function and advantage the same as those of the printing device according to the seventh aspect can be provided.

Meanwhile, a printing data producing device according to a twenty-fourth aspect of the invention produces printing data for use in a printing device including a printing head having arranged printing elements capable of forming dots on a medium used for printing. The printing device prints an image by forming dots on the printing medium by the printing head. The device includes an image data obtaining unit that obtains image data including pixel data corresponding to a plurality of pixels forming the image, a correction information storage that stores correction information that is produced based on the density change of dots formed by the printing head for pixel data having the same value in the arrangement direction of the printing elements and used for correcting the density change characteristic of each printing element, and a printing data producing unit that produces printing data that defines information related to a dot forming content by each printing element corresponding to the image data.

The printing data producing unit produces printing data based on the image data and the correction information so that a line graph representing the density change characteristic of a printing result by the printing head draws a line with a gradient.

More specifically, the aspect does not include a printing unit for actual printing like a printing device, but printing data according to the density change characteristic of the printing head is produced based on the image data having the initial M value ($M \geqq 2$)(The initial M value is pre-processing N value).

Therefore, the function and advantage the same as those of the printing device according to the first aspect can be provided, and the printing processing can be carried out by the printing device simply by sending the printing data produced according to this aspect to the printing device. Consequently, an existing type ink jet printing device can be utilized as is without preparing a dedicated printing device.

Since a general-purpose information processor such as a PC can be used, an existing printing system including a printing instruction device such as a PC and an inkjet printing device can be utilized as it is.

As an actual example of the printing data producing device, a printing device controller (controller PC externally attached to a printing device), a PC operated by a printing device driver and the like may be employed.

A printing data producing device according to a twenty-fifth aspect of the invention in the device according to the twenty-fourth aspect further includes a plurality of such printing heads, printing elements corresponding to pixel data having the same value exist among the plurality of printing heads, and the printing data producing unit controls the printing processing so that a line graph representing the density change characteristic of a printing result by the plurality of printing heads draws a line with a gradient.

In this way, the function and advantage the same as those of the printing device according to the fifth aspect can be provided.

In a printing data producing device according to a twenty-sixth aspect of the invention in the device according to the twenty-fourth or twenty-fifth aspect, the correction information includes information on a continuous function that forms a line with a gradient.

In this way, the function and advantage the same as those of the printing device according to the sixth aspect can be provided.

In a printing data producing device according to a twenty-seventh aspect of the invention in the device according to any one of the twenty-fourth to twenty-sixth aspects, the line with a gradient is at least one of a curve and a straight line having a gradient.

In this way, the function and advantage the same as those of the printing device according to the seventh aspect can be provided.

Meanwhile, a printing data producing program according to a twenty-eighth aspect of the invention is a program used for producing printing data for use in a printing device including a printing head having arranged printing elements capable of forming dots on a medium used for printing. The printing device prints an image by forming dots on the medium by the printing head. The program enables a computer to carry out processing, and the processing includes obtaining image data including pixel data corresponding to a plurality of pixels forming the image, and producing printing data that defines information related to a dot forming content by each printing element corresponding to the image data.

In the printing data producing, the printing data is produced based on the image data and correction information produced based on the density change of dots formed by the printing head for pixel data having the same value in the arrangement direction of the printing elements and used for correcting the density change characteristic of each printing element so that a line graph representing the density change characteristic of a printing result by the printing head draws a line with a gradient.

In this way, when the program is read by the computer and the computer carries out the processing according to the read program, the function and advantage the same as those of the printing data producing device according to the twenty-fourth aspect are provided.

According to a printing data producing program according to a twenty-ninth aspect of the invention in the program according to the twenty-eighth aspect, the printing device further includes a plurality of such printing heads, and printing elements corresponding to pixel data having the same value exist among the plurality of printing heads. In the printing data producing, the printing processing is controlled so that a line graph representing the density change characteristic of a printing result by the plurality of printing heads draws a line with a gradient.

In this way, when the program is read by the computer and the computer carries out the processing according to the read program, the function and advantage the same as those of the printing data producing device according to the twenty-fifth aspect can be provided.

According to a printing data producing program according to a thirtieth aspect of the invention in the program according to the twenty-eighth or twenty-ninth aspect, the correction information includes information on a continuous function that forms a line with a gradient.

In this way, when the program is read by the computer and the computer carries out the processing according to the read program, the function and advantage the same as those of the printing device according to the twenty-sixth aspect can be provided.

According to a printing data producing program according to thirty-first aspect in the program according to any one of the twenty-eighth to thirtieth aspects, the line with a gradient is at least one of a curve and a straight line having a gradient.

In this way, when the program is read by the computer and the computer carries out the processing according to the read program, the function and advantage the same as those of the printing device according to the twenty-seventh aspect can be provided.

Meanwhile, a computer-readable storage medium storing a printing data producing program according to a thirty-second aspect of the invention is a computer-readable storage medium storing a printing data producing program according to any one of the twenty-eighth to thirty-first aspects.

In this way, the function and advantage the same as those of the printing data producing control program according to any one of the twenty-eighth to thirty-first aspects are provided and the printing program may readily be exchanged through a storage medium such as a CD-ROM, a DVD-ROM, and an MO.

A method of producing printing data according to a thirty-third aspect of the invention is used for producing printing data for use in a printing device including a printing head having arranged printing elements capable of forming dots on a medium used for printing. The printing device prints an image by forming dots on the medium by the printing head. The method includes obtaining image data including pixel data corresponding to a plurality of pixels forming the image, and producing printing data that defines information related to a dot forming content by each printing element corresponding to the image data.

In the printing data producing, the printing data is produced based on the image data and correction information produced based on the density change of dots formed by the printing head for pixel data having the same value in the arrangement direction of the printing elements and used for correcting the density change characteristic of each printing element so that a line graph representing the density change characteristic of a printing result by the printing head draws a line with a gradient.

In this way, the function and advantage the same as those of the printing data producing device according to the twenty-fourth aspect can be provided.

More specifically, when a program stored in a storage medium such as a ROM in an information processor such as a PC that produces printing data is loaded to a RAM, and a CPU carries out the loaded program, an input device such as a scanner, a storage such as an HDD, an input/output interface I/F, and the like cooperate with one another to carry out the image data obtaining processing. The printing data producing is carried out when a program stored in a storage such as a ROM in an information processor such as a PC that produces printing data is loaded to a RAM, a CPU carries out the loaded program, and various kinds of data such as correction information stored in the storage are used to carry out the processing.

According to a method of producing printing data according to a thirty-fourth aspect of the invention in the method according to the thirty-third aspect, the printing device further includes a plurality of such printing heads, and printing elements corresponding to pixel data having the same value exist among the plurality of printing heads. In the printing data producing, the printing processing is controlled so that a line graph representing the density change characteristic of a printing result by the plurality of printing heads draws a line with a gradient.

In this way, the function and advantage the same as those of the printing data producing device according to the twenty-fifth aspect can be provided.

According to a method of producing printing data according to a thirty-fifth aspect of the invention in the method according to the thirty-third or thirty-fourth aspect, the correction information includes information on a continuous function that forms a line with a gradient.

In this way, the function and advantage the same as those of the printing data producing device according to the twenty-sixth aspect can be provided.

According to a method of producing printing data according to a thirty-sixth aspect of the invention in the method according to any one of the thirty-third to thirty-fifth aspect, the line with a gradient is at least one of a curve and a straight line having a gradient.

In this way, the function and advantage the same as those of the printing data producing device according to the twenty-seventh aspect can be provided.

Meanwhile, a method of producing correction information according to a thirty-seventh aspect of the invention is used for producing printing data for use in a printing device including a printing head having arranged printing elements capable of forming dots on a medium used for printing, and the printing device prints an image by forming dots on the medium by the printing head. The method includes obtaining density change characteristic information related to the density change characteristic of dots formed by the printing head for pixel data having the same value in the arrangement direction of the painting elements, obtaining gradient line information related to a line with a gradient, and producing correction information used for correcting the density change characteristic of each printing element in the printing head based on the density change characteristic information and the gradient line information so that a line graph representing the density change characteristic draws a line with a gradient.

Therefore, according to the above method, correction information allows the printing data to be produced so that a line graph representing the density change characteristic of a printing result draws a line with a gradient. With the correction information, each piece of pixel data corresponding to each printing element can be corrected so that the printing density of each printing element can be controlled to change continuously and gradually, and printing data that allows quality degradation caused by density variations attributable to the printing head to be less perceptible can readily be produced.

Meanwhile, a correction information producing device according to a thirty-eighth aspect of the invention produces correction information used for producing printing data for use in a printing device including a printing head having arranged printing elements capable of forming dots on a medium used for printing, and the printing device prints an image by forming dots on the medium by the printing head. The device includes a density change characteristic obtaining unit that obtains density change characteristic information related to the density change characteristic of dots formed by the printing head for pixel data having the same value in the arrangement direction of the printing elements, a gradient line information obtaining unit that obtains gradient line information related to a line with a gradient, and a correction information producing unit that produces correction information for each printing element in the printing head based on the density change characteristic information and the gradient line information so that a line graph representing the density change characteristic draws a line with a gradient.

In this way, the density change characteristic information related to the density change characteristic of a printing result by the printing head can be obtained by the density characteristic information obtaining unit, the gradient line information related to the line with a gradient can be obtained by the gradient line information obtaining unit, and the correction information for correcting the density change characteristic of each of the printing elements for each printing element in the printing head can be produced based on the density change characteristic and the gradient line information so that a line graph representing the density change characteristic draws a line with a gradient.

Consequently, correction information that allows the printing data to be produced so that a line graph representing the density change characteristic of a printing result draws a line with a gradient can be produced. With the correction information, each piece of pixel data corresponding to each printing element can be corrected so that the printing density of each printing element is controlled to change continuously and gradually. As a result, printing data that allows quality degradation caused by density variations attributable to the printing head to be less perceptible can readily be produced.

Herein, an actual correction information producing device may be a combination of a scanner (such as a flat bed scanner and a line sensor with a feed function) and a data processor (such as a PC) in a system for use in a manufacturing process or maintenance or a combination of a sensor attached to a printing device or a printing machine (such as a scanner and a line sensor) and a data processor (such as a printing device installed device, an externally attached controller, and an externally attached PC).

BRIEF DESCRIPTION OF THE DRAWINGS

The invention will be described with reference to the accompanying drawings, wherein like numbers reference like elements.

DESCRIPTION OF EXEMPLARY EMBODIMENTS

FIGS. 1 to 13 are for use in illustrating printing devices according to exemplary embodiments of the invention.

Figure 1:
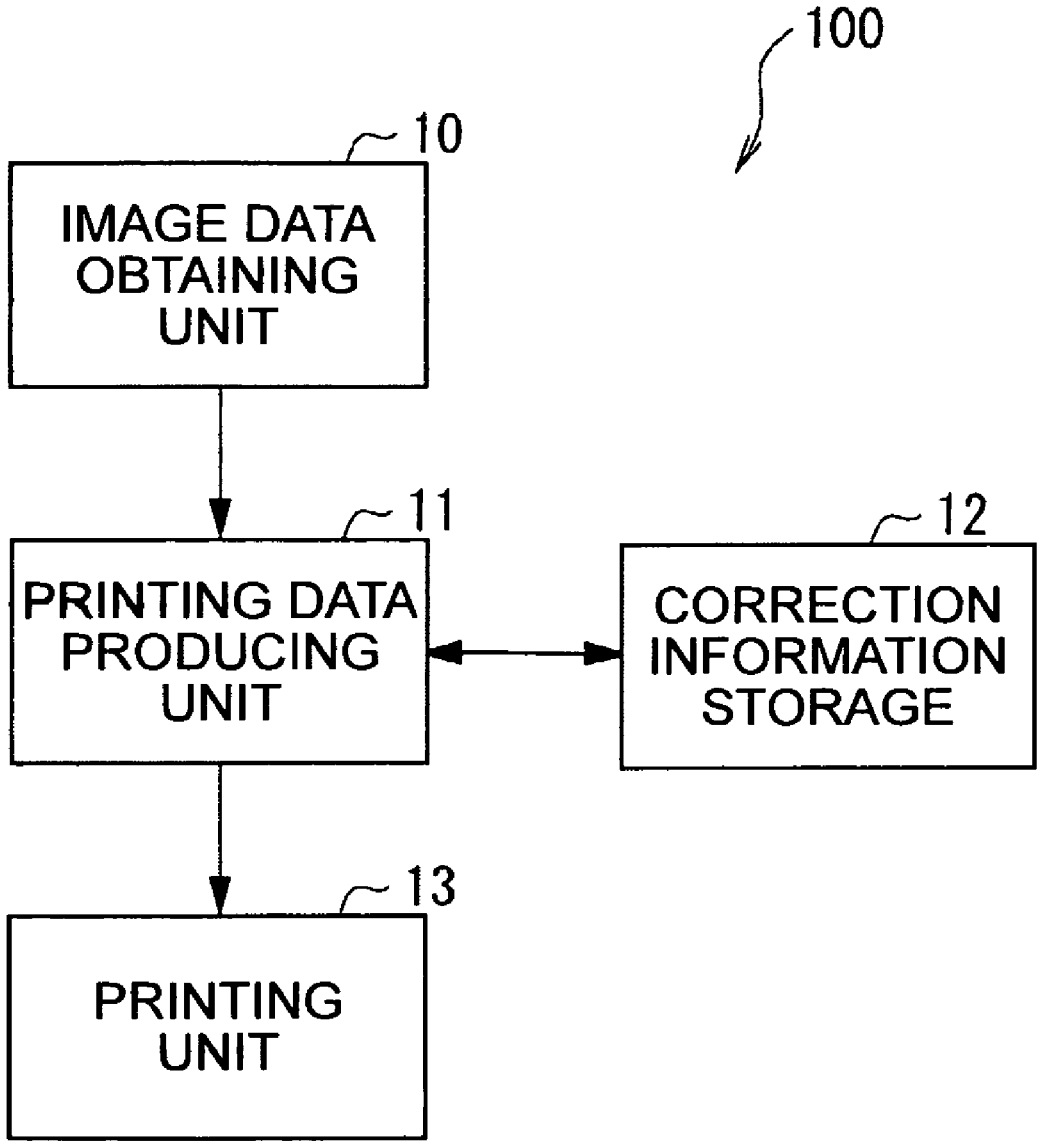
FIG. 1 is a block diagram of the configuration of a printing device 100 according to an embodiment of the invention.

The structure of a printing device 100 according to the invention will be described with reference to FIG. 1. FIG. 1 is a block diagram of the configuration of the printing device 100.

As shown in FIG. 1, the printing device 100 is a multi-head printing device and includes an image data obtaining unit 10 that obtains image data forming a prescribed image from an external device, a storage, and the like, a printing data producing unit 11 that produces printing data used for printing an image on a printing medium (printing paper in this example) based on the obtained image data and correction information stored in a correction information storage 12, the correction information storage 12 that stores correction information including various pieces of information used to correct the density change characteristics of the nozzles of the multiple heads, and a printing unit 13 that prints the image of the image data based on the printing data onto the printing medium according to inkjet process.

The image data obtaining unit 10 can obtain M-valued image data (M≧2) (such as color image data having gradations (brightness values) for each color (R, G, or B) per pixel represented by eight bits (0 to 255)). The image data obtaining unit 10 can respond to a printing instruction from an external device and an input device in the device having the unit and obtain such image data from an external device through a network such as a LAN and a WAN, from a storage medium such as a CD-ROM and a DVD-ROM through a driver such as a CD drive and a DVD drive (not shown) provided in the device having the unit, from a storage 70 (that will be described) in the device having the unit or through an optical reader such as a scanner. According to the embodiment, the image data obtaining unit 10 can also convert M-valued RGB data into M-valued CMYK data (for four colors) corresponding to each ink in the printing head 200 (hereinafter referred to as "CMYK image data").

The printing data producing unit 11 converts CMYK data received from the image data obtaining unit 10 into N-valued data for each of the CMYK colors, produces N-valued image data corresponding to each color, then selects a prescribed nozzle for each color among the nozzles to be used for printing an image based on the N-valued image data thus produced, reads out correction information corresponding to the selected nozzle and the pixel value of pixel data from the correction information storage 12 based on the pixel value of the pixel data corresponding to the selected nozzle in the N-valued image data, and corrects the pixel value of the pixel data after the N-value processing (the value of a dot forming size after the N-value processing to be exact) based on the read out correction information. In this way, the printing data is produced.

The correction information storage 12 stores correction information for a plurality of kinds of target characteristic functions that are previously provided, and the correction information is stored in the form of a data table in association with nozzle numbers and pixel values. Therefore, according to the embodiment, correction information is read out in response to information on a nozzle number, a pixel value, and a target characteristic function from the printing data producing unit 11 and the correction information corresponding to them is returned to the printing data producing unit 11. Herein, the target characteristic function is a function to define a target line (line graph) representing the density change characteristic of a printing result, and according the embodiment the user can select an arbitrary one among three kinds of functions, an elliptic function, a linear function (with a gradient), and a quadratic curve function. The correction information is used to correct the value of pixel data after N-value processing, and determined for each nozzle and each density level based on a target density value, the density variation characteristic (ink discharge performance) of each nozzle corresponding to the kind of the target characteristic function and the like. The correction information is produced by a dedicated device (correction information producing device) before the product is shipped from the factory. The dedicated device includes a unit that obtains information on a density change characteristic (density change characteristic information obtaining unit) for a printing result (such as a sample of a solid image) by each nozzle in the printing head 200, a unit that obtains gradient information related to a line with a gradient such as an ellipse, a quadratic curve, and a straight line with a prescribed gradient (gradient line information obtaining unit), a unit that produces correction information used to correct the density change characteristic for each nozzle in the printing head 200 (correction information producing device) based on the obtained information on the density change characteristic and the line with a gradient so that a line graph representing the density change characteristic by the printing head 200 draws a line with a gradient.

Figure 3:
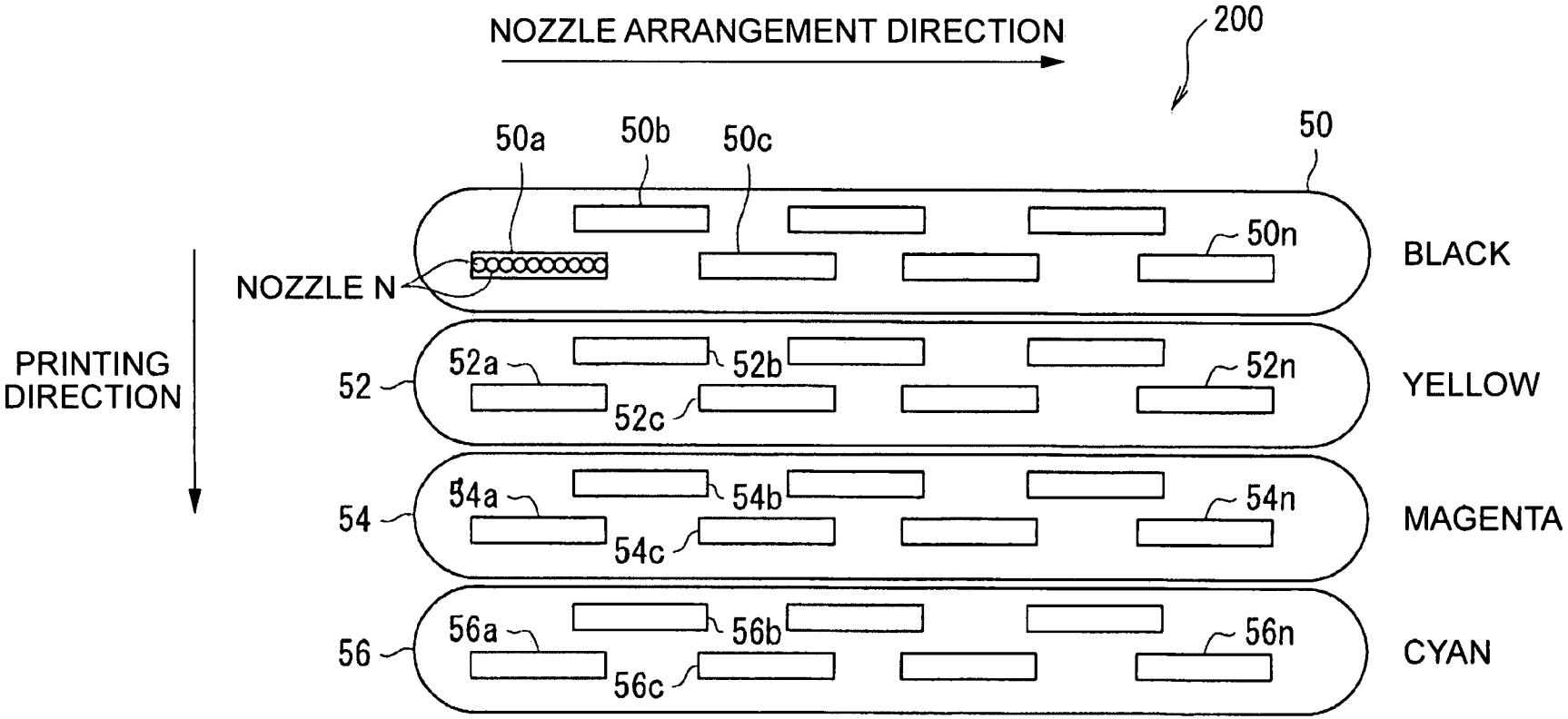
FIG. 3 is a partly enlarged, bottom view of the structure of a printing head 200 according to the invention.

Herein, FIG. 3 is a diagram of the structure of the printing head 200 according the invention in the printing unit 13.

As shown in FIG. 3, the printing head 200 includes four head units 50, 52, 54, and 56 for black, yellow, magenta, and cyan, respectively. The black head unit 50 includes a plurality of black nozzle modules 50*a* to 50*n* having a plurality of nozzles N that spray only black (K) ink aligned in the nozzle arrangement direction. The yellow head unit 52 includes a plurality of yellow nozzle modules 52*a* to 52*n* having a plurality of nozzles N that spray only yellow (Y) ink aligned in the nozzle arrangement direction. The magenta head unit 54 includes a plurality of magenta nozzle modules 54*a* to 54*n* having a plurality of nozzles N that spray only magenta (M) ink aligned in the nozzle arrangement direction. The cyan head unit 56 includes a plurality of cyan nozzle modules 56*a* to 56*n* having a plurality of nozzles N that spray only cyan (C) ink aligned in the nozzle arrangement direction.

The printing head 200 having the structure prints circular dots on white printing paper as ink supplied to ink chambers (not shown) provided corresponding to the nozzles N1, N2, N3, . . . is sprayed from the nozzles N1, N2, N3, . . . by a piezo-electric device such as a piezo actuator (not shown) provided for each ink chamber. Dots in different sizes can be printed by controlling voltage applied to the piezo-electric devices in multiple stages so that the amounts of ink discharged from the ink chambers are controlled. Voltage is applied in two stages for a short period in time-series in some cases, so that a single dot is formed by combining two kinds of discharge onto printing paper. In the latter case, since the discharge speed varies depending on the size of dots, a large dot may be discharged following a small dot, so that ink for the dots is allowed to arrive on paper in substantially identical positions, and a single larger dot can be formed.

Referring back to FIG. 1, the printing unit 13 is an inkjet printing device that forms, on a printing medium, a prescribed image made of a plurality of dots of ink sprayed in dot shapes from the nozzle modules of the head units 50, 52, 54, and 56 formed in the printing head 200 by moving one or both of the printing medium and the printing head 200. The printing device includes other mechanisms such as a paper feeding mechanism (not shown) for moving the printing medium, and a printing control mechanism (not shown) that controls ink discharge from the printing head 200 based on the printing data in addition to the printing head 200.

Figure 2:
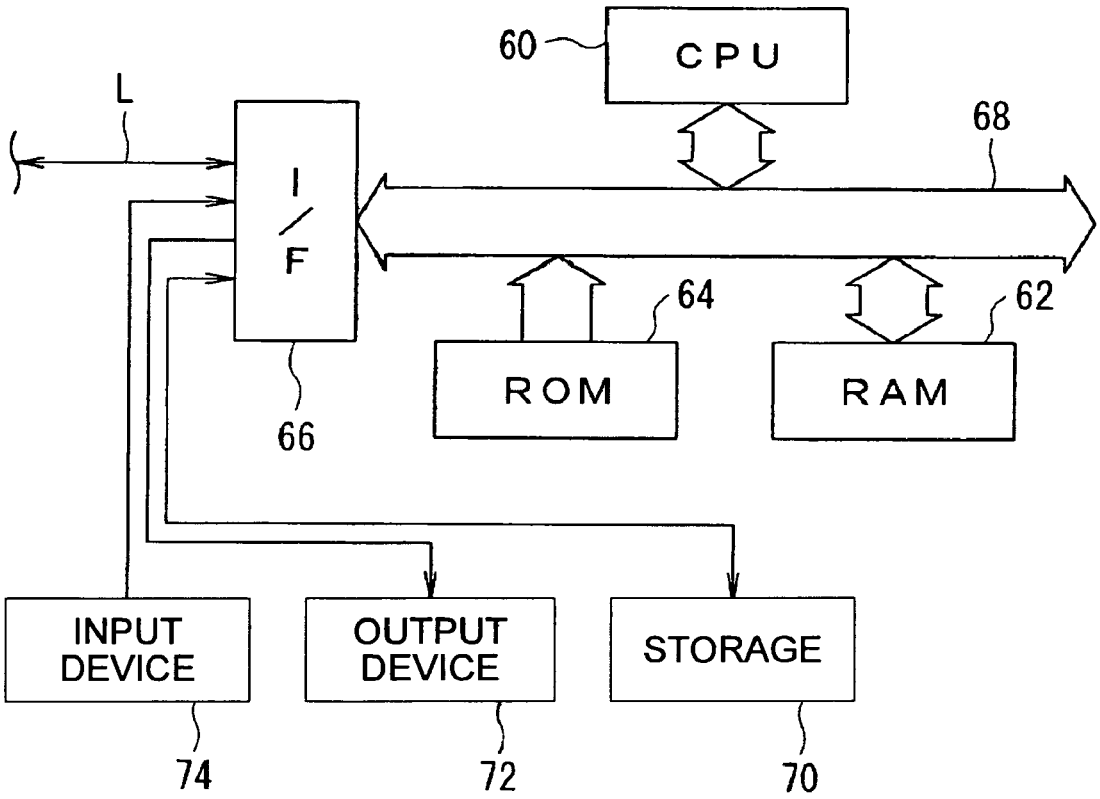
FIG. 2 is a diagram of the hardware configuration of a computer system.

The printing device 100 includes a computer system that executes software for controlling hardware necessary for implementing the above described functions in the image data obtaining unit 10, the printing data producing unit 11, and the printing unit 13, so that these functions are implemented by software. As shown in FIG. 2, in the hardware structure of the computer system, a CPU (Central Processing Unit) 60 that handles various kinds of control and operation processing, a RAM (Random Access Memory) 62 as a main storage, and a ROM (Read Only Memory) 64 are interconnected by an internal or external bus 68 made of for example a PCI (Peripheral Component Interconnect) bus or an ISA (Industrial Standard Architecture) bus. The bus 68 is connected with a network cable L through an input/output interface (I/F) 66 for communication with a secondary storage 70 such as an HDD, the printing unit 13, an output device 72 such as a CRT and an LCD monitor, an input device 74 such as an operation panel, a mouse, a keyboard, and a scanner, and a printing instructing device that is not shown.

When the power is turned on, a system program such as BIOS stored in the ROM 64 allows various special computer programs installed in the ROM 64 or various computer programs installed in the storage 70 through a storage medium such as a CD-ROM, a DVD-ROM, and a flexible disk (FD) or through a communication network such as the Internet to be loaded to the RAM 62. In this way, various functions described above are implemented on software as the CPU 60 carries out prescribed control and operation processing using various resources according to instructions described in the programs loaded on the RAM 62.

Figure 4:
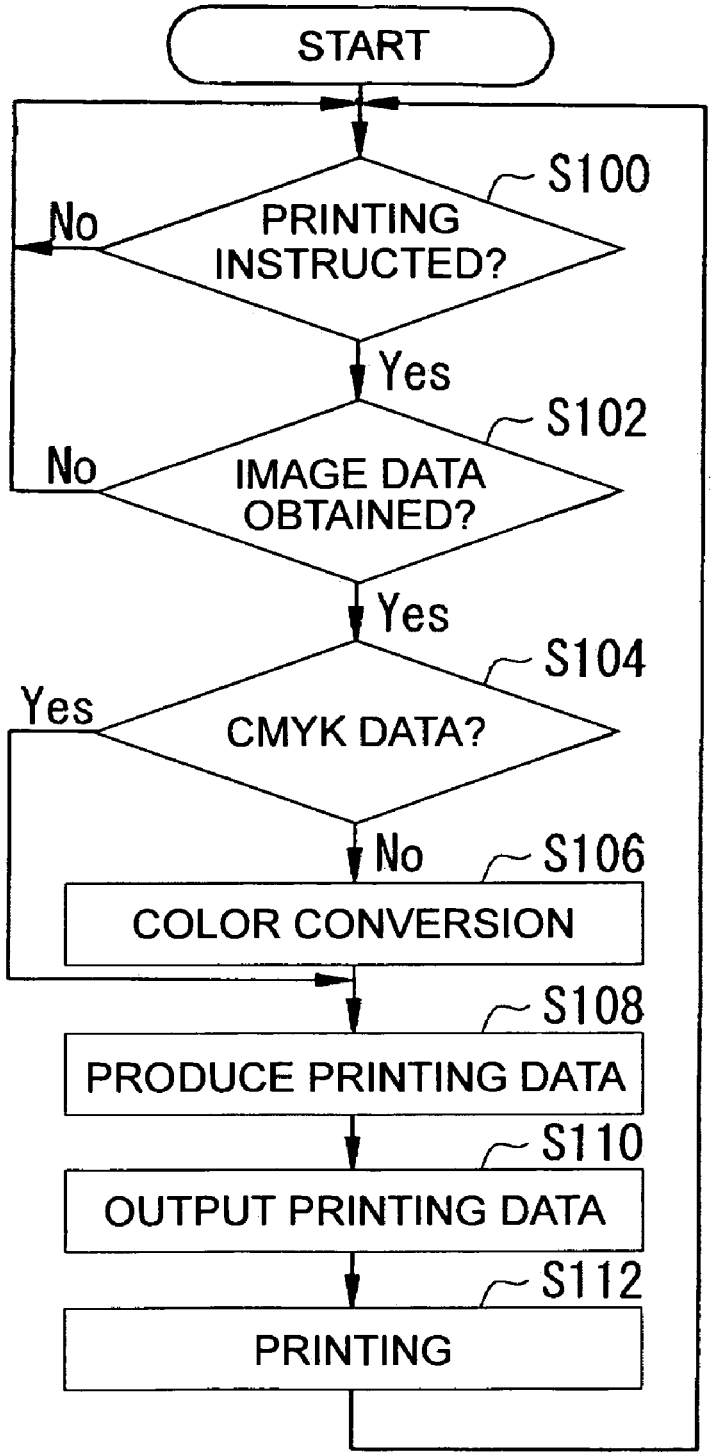
FIG. 4 is a flowchart for use in illustrating printing processing in the printing device 100.

The printing device 100 activates a prescribed program stored in a prescribed region in the ROM 64 using the CPU 60, and carries out printing processing as shown in the flowchart in FIG. 4 according to the program. The printing head 200 can generally form dots in the above-described manner, and dots in a plurality of kinds of colors such as four and six colors can be formed almost simultaneously. According to the embodiment, four head units are provided corresponding to ink in four colors (CMYK) by way of description.

FIG. 4 is a flowchart for use in illustrating printing processing in the printing device 100.

As shown in FIG. 4, in the execution of the printing processing by the CPU 60, the process proceeds to step S100 to start with.

In step S100, in the image data obtaining unit 10, printing instruction information from an external device connected through the network cable L is transmitted or input through the input device 74, so that it is determined whether or not there has been a printing instruction. If it is determined that there has been a printing instruction (Yes), the process proceeds to step S102, and if otherwise (No), the determination processing is repeated until a printing instruction is issued.

If the process proceeds to step S102, in the image data obtaining unit 10, image data corresponding to the printing instruction is obtained from an external device, a storage medium such as a CD-ROM and a DVD-ROM, and the storage 70 such as an HDD, and then it is determined whether image data has been obtained. If it is determined that the data has been obtained (Yes), the process proceeds to S104. If otherwise (No), a response about printing impossibility or the like is made to the party that has issued the printing instruction, then printing processing in response to the printing instruction is abandoned, and the process proceeds to step S100.

If the process proceeds to step S104, in the image data obtaining unit 10, it is determined whether or not the image data obtained in step S102 is CMYK image data. If it is determined that the data is CMYK image data (Yes), the process proceeds to step S108, while if otherwise (No), the process proceeds to step S106.

If the process proceeds to step S106, in the image data obtaining unit 10, color information (such as RGB) on image data other than CMYK image data obtained in step S102 is converted to CMYK data, and the produced CMYK imaged data is transmitted to the printing data producing unit 11. Then, the process proceeds to step S108.

In step S108, in the printing data producing unit 11, when the CMYK image data is obtained from the image data obtaining unit 10, printing data producing processing is carried out to produce printing data, and then the process proceeds to step S110.

In step S110, in the printing data producing unit 11, the printing data produced in step S108 is output to the printing unit 13, and the process proceeds to step S112.

In step S112, in the printing unit 13, printing processing is carried out based on the printing data from the printing data producing unit 11, and the process proceeds to step S100.

Now, with reference to FIG. 5, the printing data producing processing in step S108 will be described in detail.

Figure 5:
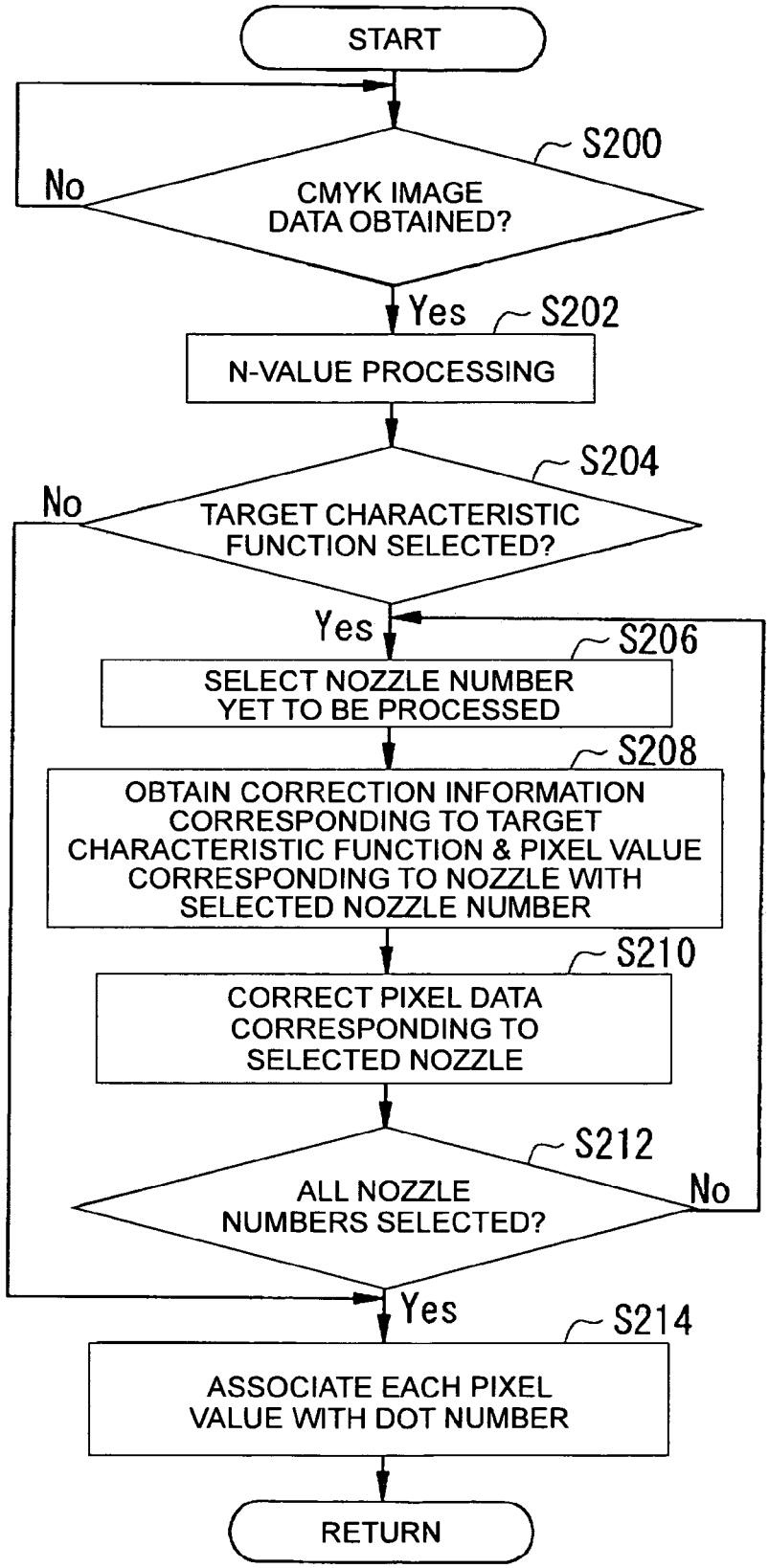
FIG. 5 is a flowchart for use in illustrating printing data producing processing in a printing data producing unit 11 in the printing device 100.

FIG. 5 is a flowchart for use in illustrating the printing data producing processing in the printing data producing unit 11 in the printing device 100.

In the printing data producing processing, printing data is produced so that a line graph representing the density change characteristic of dots formed for pixel data having the same value by the head units in the arrangement direction of the printing elements (nozzles) in the printing head 200 draws a line having a prescribed gradient. As shown in FIG. 5, when the processing is carried out in step S108, the process proceeds to step S200 to start with.

In step S200, in the printing data producing unit 11, it is determined whether or not CMYK image data from the image data obtaining unit 10 has been obtained. If it is determined that the data has been obtained (Yes), the process proceeds to step S202. If otherwise (No), the determination processing is repeated until the data is obtained.

If the process proceeds to step S202, in the printing data producing unit 11, the CMYK image data is subjected to resolution conversion corresponding to the printing resolution at the time of printing and N-value processing. In this way, N-valued data is produced, and the process proceeds to step S204.

In step S204, in the printing data producing unit 11, it is determined whether or not one of the kinds of target characteristic functions has been selected. If it is determined that a kind has been selected (Yes), the process proceeds to step S206. If otherwise (No), the process to step S214. According to the embodiment, the user can select whether or not to correct density variations attributable to the printing head. At the time, a density change characteristic after the correction can be selected among a plurality of target characteristic functions prepared. Information on the selected target characteristic function is added to printing instruction information or image data for transmission to the printing device 100.

In step S206, in the printing data producing unit 11, the number of a nozzle yet to be subjected to correction processing is selected, and the process proceeds to step S208. According to the embodiment, nozzles forming each head unit are numbered in consecutive order for each nozzle unit in the printing head 200. Therefore, the number of a nozzle yet to be processed is selected for each head unit.

In step S208, in the printing data producing unit 11, correction information corresponding to the target characteristic function and the selected nozzle number is read out and obtained from the correction information storage 12, and the process proceeds to step S210.

In step S210, in the printing data producing unit 11, pixel data corresponding to the selected nozzle is selected from the CMYK image data, the selected pixel data is corrected based on the correction information obtained in step S208, and the process proceeds to step S212.

In step S212, in the printing data producing unit 11, it is determined whether or not all the nozzle numbers have been selected, and if it is determined that all the nozzle numbers have been selected (Yes), the process proceeds to step S214. If otherwise (No), the process proceeds to step S206.

In step S214, in the printing data producing unit 11, printing data is produced by associating information related to a dot forming content with each pixel value of the CMYK image data, the series of processing steps thus end, and the process returns to the initial processing. Herein, the information related to the dot forming content includes information related to the size of dots formed by nozzles such as a dot number corresponding to each dot size. The operation of the embodiment will be described with reference to FIGS. 6 to 11.

Figure 6:
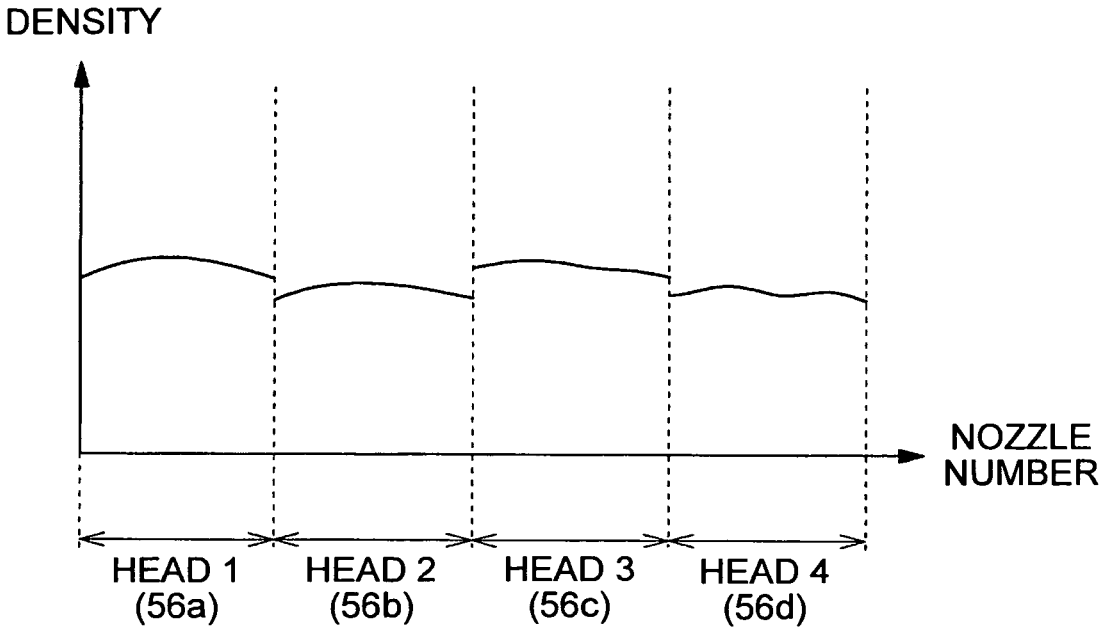
FIG. 6 shows the relation between nozzle numbers corresponding to head units and the output density values of the nozzles for pixel data having a certain identical value when correction processing for density variations is not carried out.
Figure 7:
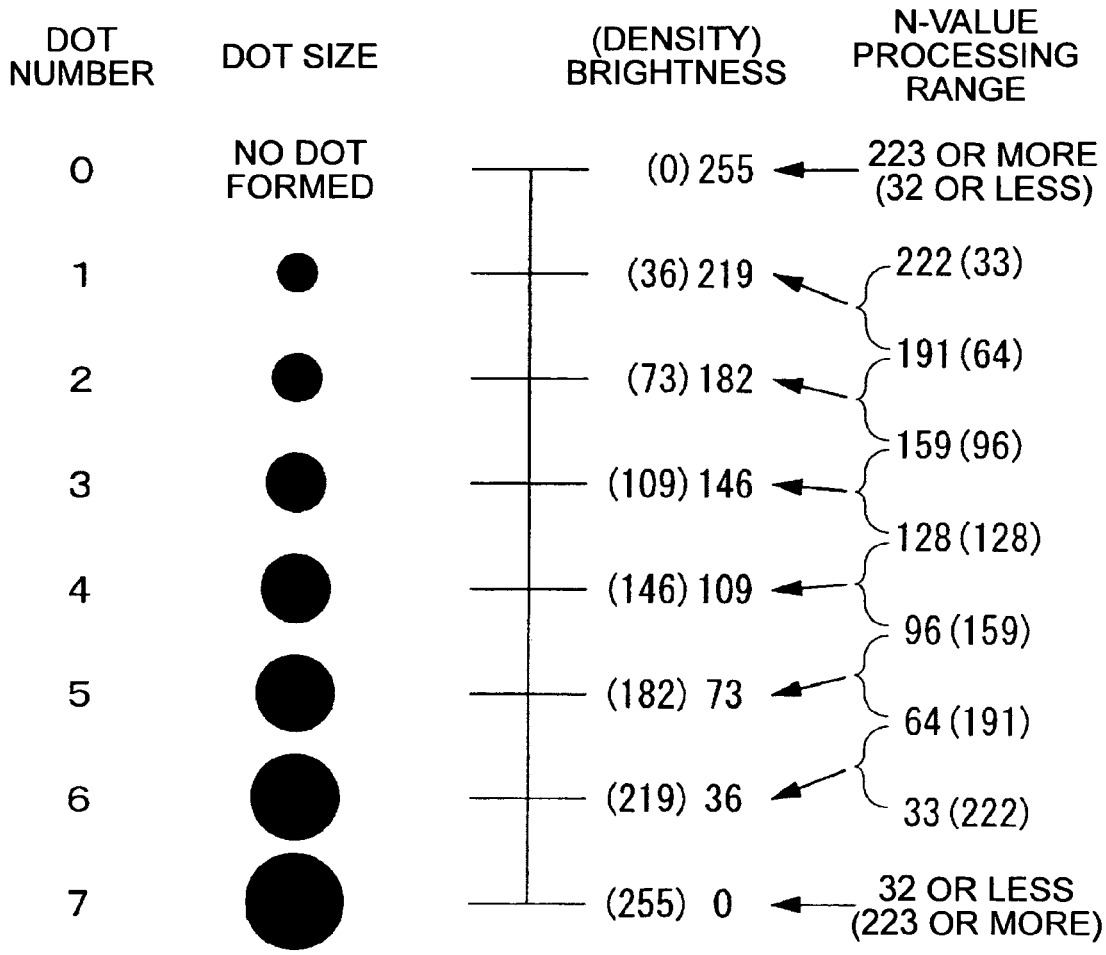
FIG. 7 shows an example of N value information and threshold information for the N values corresponding to dot sizes.
Figure 8:
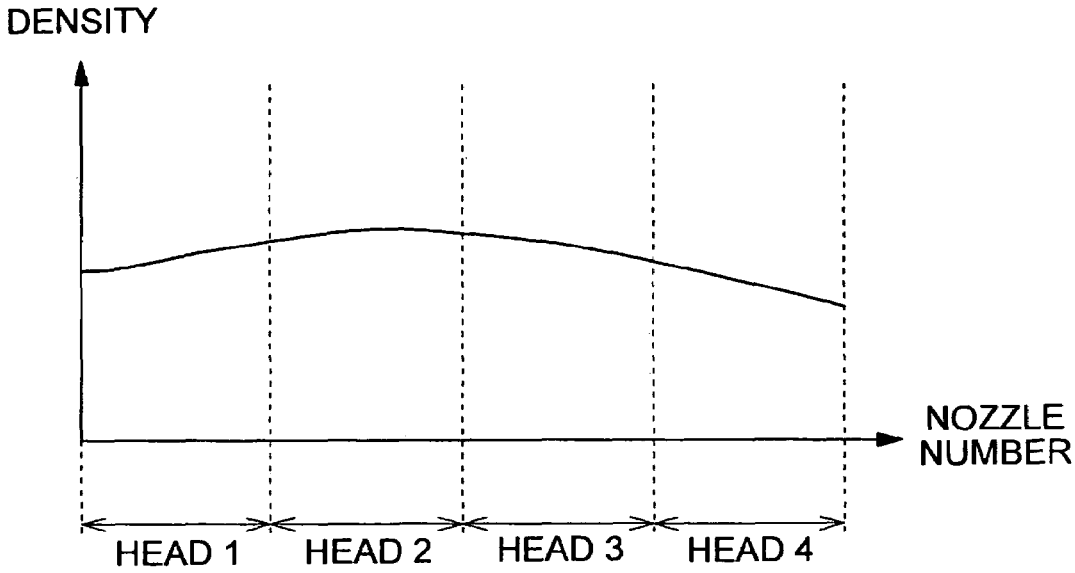
FIG. 8 shows the relation between nozzle numbers corresponding to head units and the output density values of the nozzles for pixel data having a certain identical value when correction processing is carried out with an elliptic function selected as a target characteristic function.
Figure 9:
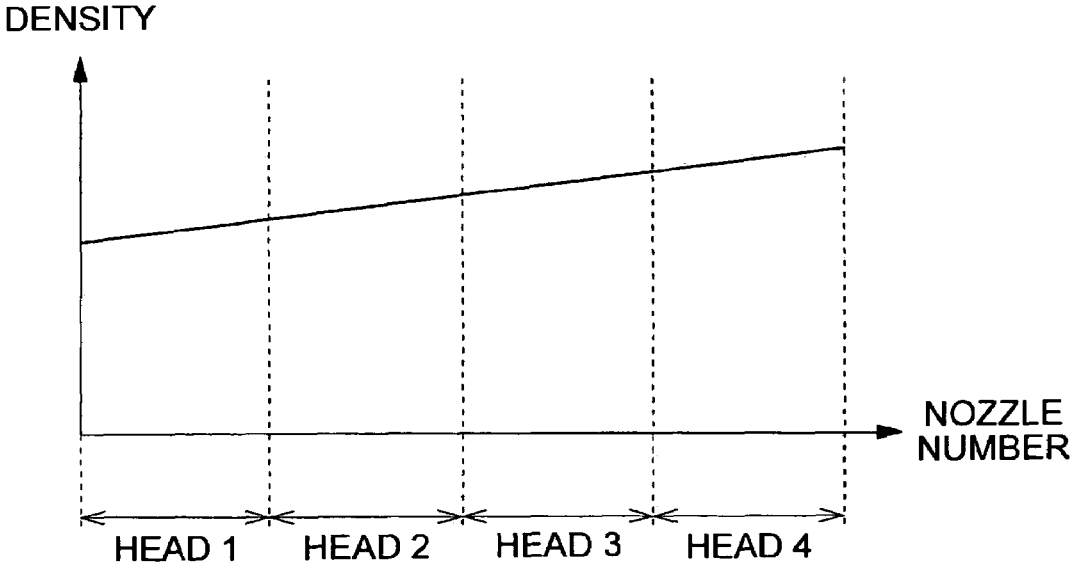
FIG. 9 shows the relation between nozzle numbers corresponding to head units and the output density values of the nozzles for pixel data having a certain identical value when correction processing is carried out with a linear function selected as a target characteristic function.
Figures 10, 11:
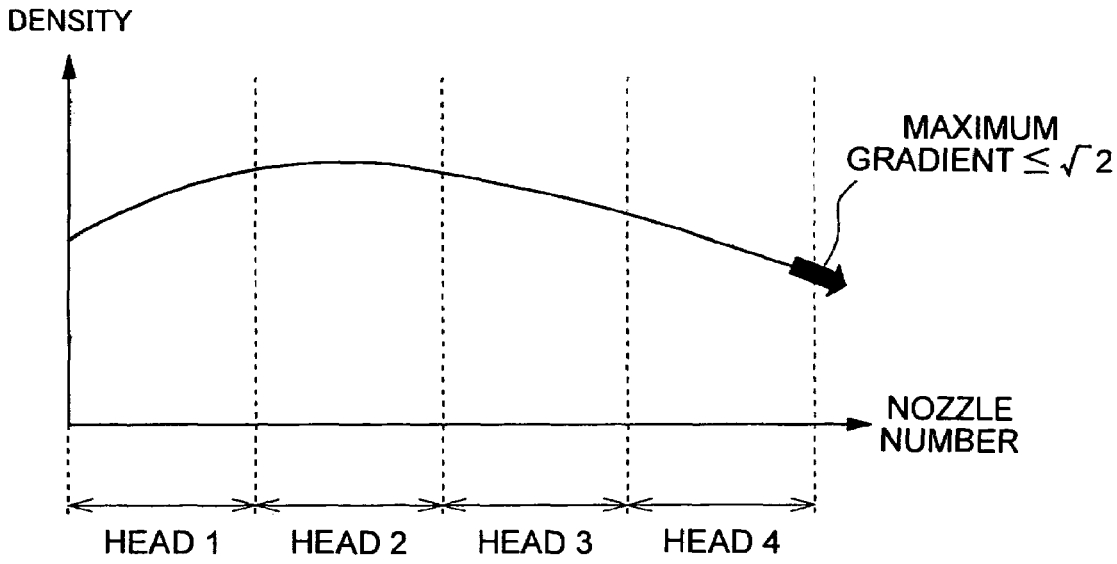
FIG. 10 shows the relation between nozzle numbers corresponding to head units and the output density values, of the nozzles for pixel data having a certain identical value when correction processing is carried out with a quadratic curve function selected as a target characteristic function.
FIG. 11 shows an example of a correction information table.

Herein, FIG. 6 shows the relation between nozzle numbers corresponding to head units and the output density values of the nozzles for pixel data at a certain identical value when density variations are not corrected. FIG. 7 shows an example of N value information and threshold information for the N values corresponding to dot sizes. FIG. 8 shows the relation between nozzle numbers corresponding to head units and the output density values of the nozzles for pixel data at a certain identical value when correction processing is carried out with an elliptic function selected as a target characteristic function. FIG. 9 shows the relation between nozzle numbers corresponding to head units and the output density values of the nozzles for pixel data at a certain identical value when correction processing is carried out with a linear function selected as a target characteristic function. FIG. 10 shows the relation between nozzle numbers corresponding to head units and the output density values of the nozzles for pixel data at a certain identical value when correction processing is carried out with a quadratic curve function selected as a target characteristic function. FIG. 11 shows an example of a correction information table.

In general, the nozzles in the printing head 200 have uneven characteristics about the discharge amount of ink or the discharge direction of ink and therefore as shown in FIG. 6, the output density value is unequal among the nozzles in cyan nozzle modules 56*a* to 56*d* and among the nozzle modules for a printing item such as a "solid printing item" having an equal density. The density abruptly changes particularly at a joining part between nozzle modules such as the joining part between the nozzle modules 56*a* and 56*b*. Such abrupt density change can be perceived visually as density variations when it is expressed on a printing item and degrade the quality of the printing item.

Herein, the output density value is the density value of dots formed by each of the nozzles as the result of printing.

Therefore, in the printing device 100 according to the invention, image data for printing is corrected so that the output density values of the nozzles align in the arrangement order of the nozzles and along a line having a prescribed gradient on a line graph having the prescribed gradient so that the density value of dots can be prevented from abruptly changing among the nozzles. In this way, the output density value changes gradually (continuously) among the nozzles, so that printing data that allows density variations to be prevented from being perceived on a printing item can be produced.

Upon receiving printing instruction information from an external device in the image data obtaining unit 10 (step S100), the printing device 100 obtains image data corresponding to the printing instruction information from the external device that has transmitted the printing instruction information (step S102). If the color information of the obtained image data is information other than CMYK such as RGB information (branch for "Yes" in step S104), CMYK image data produced by converting the image data into CMYK data is transmitted to the printing data producing unit 11 (step S106). The printing data producing unit 11 obtains the CMYK image data transmitted from the image data obtaining unit 10 and executes printing data producing processing (step S108).

The printing data producing processing is initiated in the printing data producing portion 11 once the CMYK image data transmitted from the image data obtaining unit 10 is obtained (step S200), and the obtained CMYK image data has its resolution converted according to the printing resolution for actual printing. Then, N-value processing information including a threshold for N-value processing corresponding to each piece of size information for forming dots and a density value stored in the storage 70 is read out. Then, pixel data yet to be subjected to N-value processing in the CMYK image data after its resolution conversion is selected based on the N-value processing information, and the selected pixel data is subjected to N-value processing (step S202).

Assume that in the N-value processing according to the embodiment, the pixel value (brightness (or density)) of the selected pixel data before the N-value processing is represented for example by 8-bit, 256 gradation levels. As shown in FIG. 7, when for example the pixel value before the N-value processing (hereinafter simply as "pre-processing pixel value") is 32 or less, the pixel value is set as 0 and when the pre-processing pixel value is not less than 33 and less than 64, the pixel value is set as 36. When the pre-processing pixel value is not less than 64 and less than 96, the pixel value is set as 73. When the pre-processing pixel value is not less than 96 and less than 128, the pixel value is set as 109 and when the pre-processing pixel value is not less than 128 and less than 159, the pixel value is set as 146. when the pre-processing pixel value is not less than 159 and less than 191, the pixel value is set as 182. When the pre-processing pixel value is not less than 191 and less than 223, the pixel value is set as 219 and when the pre-processing pixel value is not less than 223, the pixel value is set as 255.

Note that in the described example, brightness is employed for the pixel value, while if the density is employed for the pixel value, the reverse of each brightness value (produced by subtracting each brightness value from 255) as shown in parentheses will be employed. In the described example, the pixel value of the selected pixel data is converted into one of eight kinds of numerical values including a brightness value "zero" according to the kind of available dot sizes, in other words, so-called eight-value processing is carried out. The printing device 100 is not limited to the use of these eight kinds of numerical values (dot forming sizes). The number N in the N-value processing varies depending on the number of kinds of dot forming sizes necessary for allowing the output density values of the nozzles to attain a target density change characteristic.

The dot sizes can readily be controlled in this way for example by the use of a piezo actuator for a printing head, in which the amount of ink to be discharged is controlled by changing voltage applied to the piezo actuator. Nozzles dedicated for dot sizes may be provided, so that which nozzle to discharge ink may be controlled.

As in the foregoing, when N-value processing is carried out to selected pixel data, the error between the brightness value of the selected pixel data before the N-value processing and the brightness value corresponding to the dot number after the N-value processing is calculated, and the calculated error is diffused among pixels around the pixel of the selected pixel data yet to be subjected to N-value processing, in other words, error diffusion processing is carried out.

The error diffusion processing has been known. In binarizing processing for example, if a target pixel to be processed can be expressed in eight bits (256 gradation levels), and its gradation level is 101, which is less than 128, the threshold (intermediate value) in normal binarization processing, the pixel is processed as zero, in other words, it is processed as a pixel not forming a dot and the value "101" is discarded. In contrast, in the error diffusion processing, the value "101" is diffused among surrounding pixels yet to be processed according to a prescribed error diffusion matrix. Therefore, the pixel on the right of the selected pixel that is less than the threshold value as with the selected pixel and would otherwise be processed as "not forming a dot" by simple binarization processing is treated as "forming a dot" since the error for the selected pixel is added. Therefore, binarized data more approximated to the original image data can be obtained.

More specifically, a brightness value for each of dot forming sizes as described above is used in the error diffusion processing, and the difference between the density value of the original pixel data and the brightness value of a corresponding dot forming size after N-value processing is diffused as an error among surrounding pixel data yet to be processed.

Once the above-described N-value processing and error diffusion processing are complete to all the pixel data in the CMYK image data, the CMYK image data after the N-value processing and error diffusion processing becomes N-valued image data.

Once the N-valued image data is produced in this manner, it is determined whether or not a target characteristic function has been selected based on the printing instruction information or information attached to the obtained image data (step S204). Based on the result of determination, if a target characteristic function has been selected (branch for "Yes" in step S204), each pieces of pixel data after N-value processing is corrected depending on the kind of the selected target characteristic function.

Herein, according to the embodiment, three kinds of functions, i.e., an elliptic function, a linear function, and a quadratic curve function are prepared as target characteristic functions.

If a target characteristic function has been selected, a nozzle number yet to be subjected to correction processing is selected for each head unit (step S206), and correction information corresponding to the selected target characteristic function, the selected nozzle number, and pixel data corresponding to the selected nozzle number is read out from the correction information storage 12 (step S208), and the pixel data corresponding to the selected nozzle is corrected based on the read out correction information (step S210).

If a target characteristic function has been selected, N-valued image data is to be corrected so that the output density values of the nozzles align on a line graph representation of the selected target characteristic function in the order of arrangement.

Therefore, according to the embodiment, correction information based on which the output density of each nozzle draws line graphs corresponding to the three kinds of target characteristic functions are prepared as a data table for each head unit and each density with which a dot can form. According to the embodiment, for the elliptic function and the quadratic curve function among the target functions described above, correction information for each nozzle is produced so that the gradient of the tangent line is not more than $\sqrt{2}$, and for the linear function, correction information for each nozzle is produced so that the minimum density value on the line is at least 80% of the maximum density value. In other words, a condition for the gradient is set so that the output density value changes gradually rather than abruptly, and the correction information is produced according to the condition.

As for the correction information to produce, if a certain nozzle has such a density change characteristic that the discharge amount is "−2%" relative to a target ink discharge amount, and the nozzle should discharge ink "+5%" relative to the target ink discharge amount in order to match a line representation of the target characteristic function, information that corrects the pixel data so that the ink discharge amount is "+7%" is produced as correction information in consideration of "−2%."

The correction information produced in this manner is stored for example in the correction information storage 12 as a correction information table as shown in FIG. 11. In the example shown in FIG. 11, a coefficient is set as correction information each for a linear function, one of the target characteristic functions, a nozzle number corresponding to each of the nozzles of the cyan head unit 56, and a dot formable density range, and a result produced by multiplying a pixel value after N-value processing by a corresponding coefficient is produced as a corrected pixel value.

Therefore, when an elliptic function is selected as a target characteristic function, correction information (coefficient) corresponding to the elliptic function, a selected nozzle and a pixel value corresponding to the selected nozzle is selected, and the pixel value corresponding to the selected nozzle is corrected based on the selected correction information (multiplied by the coefficient). Similarly, when a linear function or a quadratic curve function is selected as a target characteristic function, correction information corresponding to the selected target characteristic function, a selected nozzle, and a pixel value corresponding to the selected nozzle is selected, and the pixel value corresponding to the selected nozzle is corrected based on the selected correction information.

Once the above-described correction processing is complete to all the nozzles in all the head units (branch for "Yes" in step S212), a dot size is associated to the N-valued image data obtained as the result of correction processing, and printing data is produced (step S214).

The printing data producing unit 11 the outputs the produced printing data to the printing unit 13 (step S110).

In the printing unit 13, dots are formed (printed) on a printing medium using the printing head 200 based on the printing data output from the printing data producing unit 11 (step S112).

The density change characteristic of dots in the printing result is such that the output density value of each nozzle draws a part of an ellipse as shown in FIG. 8 when an elliptic function is selected as a target characteristic function. Meanwhile, when a linear function is selected as a target characteristic function, the gradient of the straight line drawn by the output density value is such that the minimum density value on the line is 80% of the maximum density value as shown in FIG. 9. When a quadratic curve function is selected as a target characteristic function, a characteristic follows such a curve that the gradient of the tangent of the quadratic curve is not more than $\sqrt{2}$ as shown in FIG. 10.

Therefore, the printing data is produced by correcting the N-valued image data so that the printing result has a density change characteristic as shown in FIGS. 8 to 10, and therefore, the density change can be gradual among the nozzles and nozzle modules. Therefore, density variations in a resulting printed material can be less perceptible.

According to the embodiment, the image data obtaining unit 10 corresponds to the image data obtaining unit according to any one of the first, fourth, and twenty-fourth aspects, the printing data producing unit 11 corresponds to the printing data producing unit according to any one of fourth, fifth, twenty-fourth, and twenty-fifth aspects or the printing control unit according to the first aspect, the correction information storage 12 corresponds to the correction information storage according to the fourth or twenty-fourth aspect, and the printing unit 13 corresponds to the printing unit according to the first or fourth aspect.

According to the above-described embodiment, steps S100 to S106 correspond to the image data obtaining according to any one of the eighth, eleventh, seventeenth, twentieth, twenty-eighth, and thirty-third aspects, step S108 corresponds to the printing data producing according to any one of the eleventh, twelfth, seventeenth, twentieth, twenty-first, twenty-eighth, twenty-ninth, thirty-third, and thirty-fourth, or the printing control according to the eighth aspect, and step S112 corresponds to the printing according to any one of the eighth, eleventh, seventeenth, twentieth, twenty-eighth, and thirty-third aspects.

According to the above-described embodiment, correction information (such as a coefficient) is prepared for each of the nozzles in each of the head units and for each of the density levels as a data table. However, such a data table may be set in other ways.

Information on a target characteristic function, a coefficient for the target characteristic function corresponding to each of density levels (for example a and b in y=ax+b for a linear function) is prepared as a table. An output value (y) for a continuous function is calculated while an input value (x) is each nozzle number. Then, using a calculation result (y) as a density value targeted by each nozzle, correction may be carried out so that the output result of each nozzle satisfies a corresponding target density value based on the density value and the density variation characteristic of each of the nozzles (such as the discharge amount minus 5%). Only information on a target characteristic function may be prepared, and a coefficient for the target characteristic function may be calculated every time it is required. In this case, the correction information storage 12 obtains for example kind information on the target characteristic function, a selected nozzle number, and pixel data corresponding to the selected nozzle from the printing data producing unit 11, then calculates a target density value based on these kinds of information, corrects the pixel data corresponding to the selected nozzle based on the result of calculation and the density characteristic information of the selected nozzle, and produces printing data used to allow the selected nozzle to output the target density value.

In this way, according to the embodiment, correction information that could be huge in quantity depending on the density range can be produced on an as-needed basis, and therefore the memory amount of information necessary for correction processing can be reduced.

According to the above-described embodiment, correction information (such as a coefficient) is prepared as a data table for each nozzle in each head unit and for each density level. However, rather than carrying out the above-described correction processing to N-valued image data after N-value processing, a dot size number may be allocated to the N-valued image data to produce printing data, based on which printing may be carried out and the density value of each nozzle for the printing result may be measured. Then, using the measurement value, for example a coefficient for a target characteristic function may be calculated by curve approximation or straight line approximation to the target characteristic function using known least square process, and a target density value for each nozzle may be calculated from a target characteristic function having the coefficient. In this case, the correction information storage 12 stores the density characteristic information of each nozzle. Once the target density value is calculated, N-valued image data may be corrected based on the density characteristic information of each nozzle so that the output density value of each nozzle equals the target density value, or a data table as in the above-described embodiment may be produced based on the measured density characteristic information.

In this way, a straight line or curve having an appropriate gradient corresponding to the density characteristic of each nozzle can be obtained, so that density variations can be repressed in even more natural appearance on a printing result.

According to the above-described embodiment, using correction information, printing data that allows the density value of the printing result of each head unit to draw a line corresponding to a target characteristic function is produced by a dedicated program. However, alternatively, a signal produced from normal printing data without being subjected to the above correction processing may be passed through a dedicated circuit and directly corrected for example by correcting the level of voltage to be applied to a piezo actuator or the like using hardware such as an electric circuit. In this way, printing processing may be controlled so that the density value of each nozzle on the printing result draws a line corresponding to a target characteristic function. In this case, for example in the printing unit 13, signal conversion with an electric circuit can be carried out, and the printing unit 13 having the function corresponds to the printing unit according to the first or second aspect.

According to the embodiment, the correction processing is carried out to the entire N-valued image data, but the correction processing may be carried out only to a solid image part having at least a prescribed area.

Figure 12:
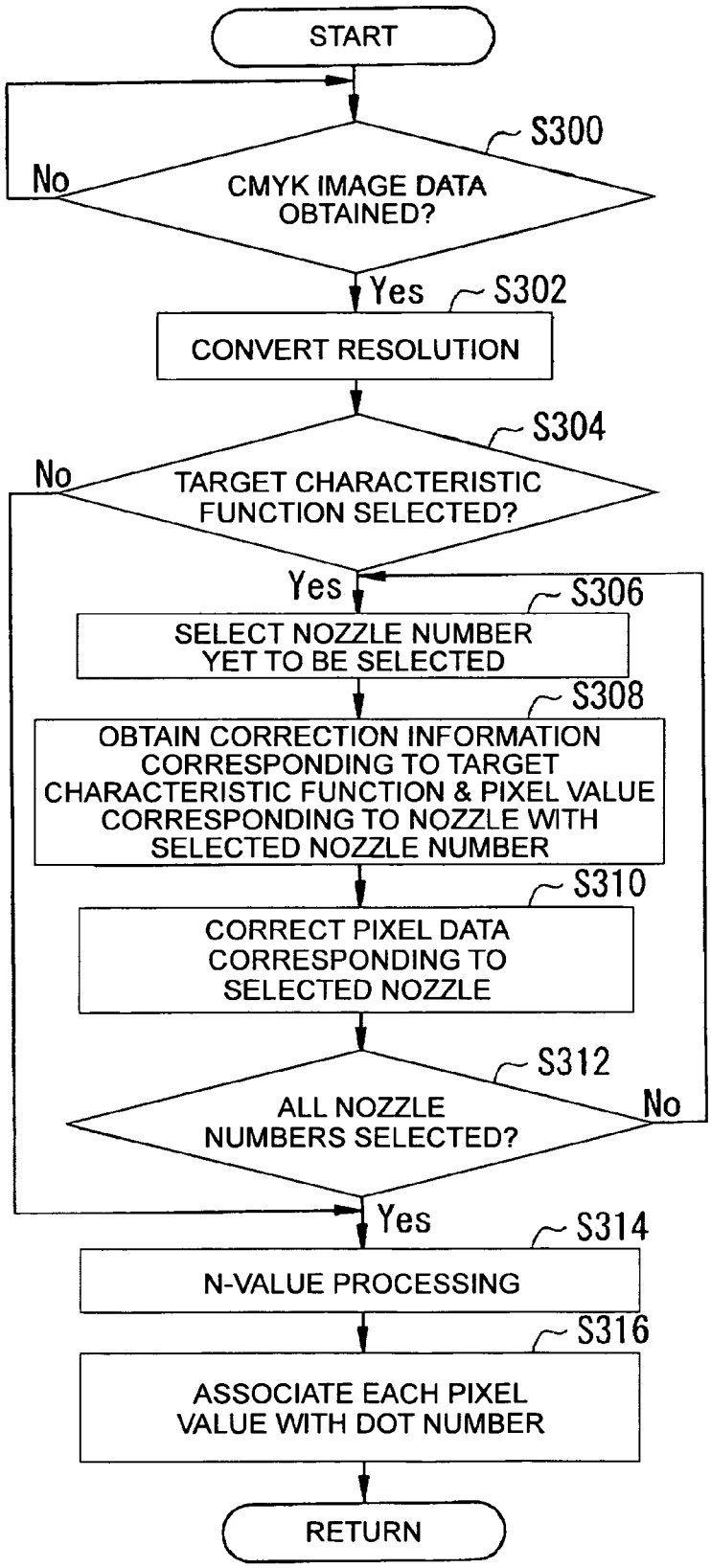
FIG. 12 is a flowchart for use in illustrating printing data producing processing shown in FIG. 5 according to another aspect.

According to the embodiment, as shown in the flowchart in FIG. 5, N-value processing is carried out in step S202 and then the pixel value of the N-valued image data is corrected through steps S204 to S210, but alternatively, for example as shown in the flowchart in FIG. 12, CMYK image data may be corrected and then subjected to N-value processing. Now, with reference to FIG. 12, another example of flow of printing data producing processing in the printing data producing unit 11 will be described. FIG. 12 is a flowchart for use in illustrating the alternative example of the printing data producing processing in FIG. 5.

In the printing data producing processing, printing data is produced so that a line graph representing the density change characteristic of a printing result by each head unit in the printing head 200 draws a line having a prescribed gradient. When the processing is carried out in step S106, as shown in FIG. 12, the process proceeds to step S300 to start with.

In step S300, in the printing data producing portion 11, it is determined whether or not CMYK image data has been obtained from the image data obtaining unit 10. If it is determined that the data has been obtained (Yes), the process proceeds to step S302, and if otherwise (No), the determination processing continues until the data is obtained.

If the process proceeds to S302, in the printing data producing unit 11, the CMYK image data obtained as described above is subjected to resolution conversion according to a printing resolution, and then the process proceeds to step S304.

In step S304, in the printing data producing unit 11, it is determined whether or not the kind of a target characteristic function has been selected. If it is determined that the kind has been selected (Yes), the process proceeds to step S306. If otherwise (No), the process proceeds to step S314.

In step S306, in the printing data producing unit 11, a nozzle number yet to be subjected to correction processing is selected and the process proceeds to step S308.

In step S308, in the printing data producing unit 11, correction information corresponding to the target characteristic function and the selected nozzle number is obtained from the correction information storage 12, and then the process proceeds to step S310.

In step S310, in the printing data producing unit 11, pixel data corresponding to the selected nozzle is selected from the CMYK data, the selected pixel data is corrected based on the correction information obtained in step S308, and the process proceeds to step S312.

In step S312, in the printing data producing unit 11, it is determined whether or not all the nozzle numbers have been selected. If all the numbers have been selected (Yes), the process proceeds to step S314, and if otherwise (No), the process proceeds to step S306.

If the process proceeds to step S314, in the printing data producing unit 11, the corrected CMYK image data is subjected to N-value processing, N-valued image data is thus produced, and then the process proceeds to step S316.

In step S316, in the printing data producing unit 11, printing data is produced by associating each of the pixel values in the N-valued image data with information related to a dot forming content, the series of processing steps thus ends, and the process returns to the initial processing.

More specifically, the printing data producing unit 11 carries out resolution conversion according to a printing resolution in actual printing to the CMYK image data obtained from the image data obtaining unit 10 (step S302), a target characteristic function is selected for the CMYK image data having its resolution converted (step S304), correction information corresponding to the target characteristic function is obtained to correct the pixel data corresponding to a selected nozzle accordingly (steps S306 to S312), the CMYK image data thus corrected is subjected to N-value processing (step S314), and the N-valued image data is associated with a dot number to produce printing data (step S316).

In this way, the density change between the nozzles and between the nozzle modules can be gradual, so that density variations in printing materials can be less perceptible.

The characteristic of the printing device 100 according to the embodiment lies in that printing data can be produced from image data according to the characteristic of its printing head almost without affecting the existing type printing device itself, so that no special dedicated unit is necessary for the printing unit 13. Therefore, a conventional inkjet type printing device as is can be utilized. If the printing unit 13 is detached from the printing device 100 according to the embodiment, its function can be implemented by a general purpose printing instruction terminal such as a PC or a printing device server (printing data producing device).

The printing device 100 according to the embodiment is applicable not only to a multi-head, line head type inkjet printing device but also to a single head, line head type inkjet printing device, and a multi-pass type inkjet printing device.

Figure 13A:
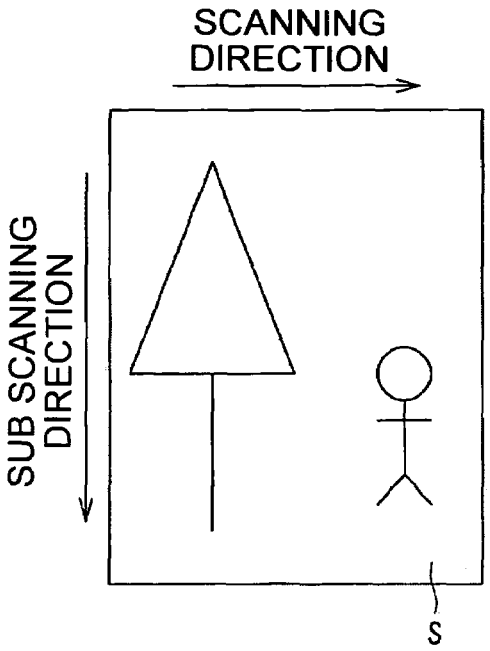
FIGS. 13A to 13C show the difference between the printing methods by a multi-pass type inkjet printing device and a line head type inkjet printing device.
Figure 13B:
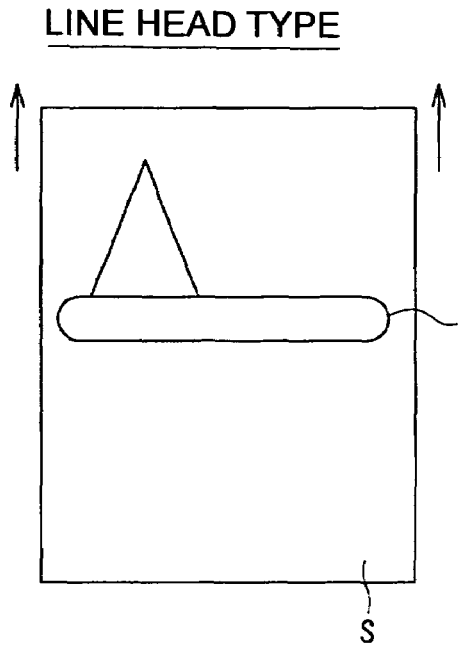
Figure 13C:
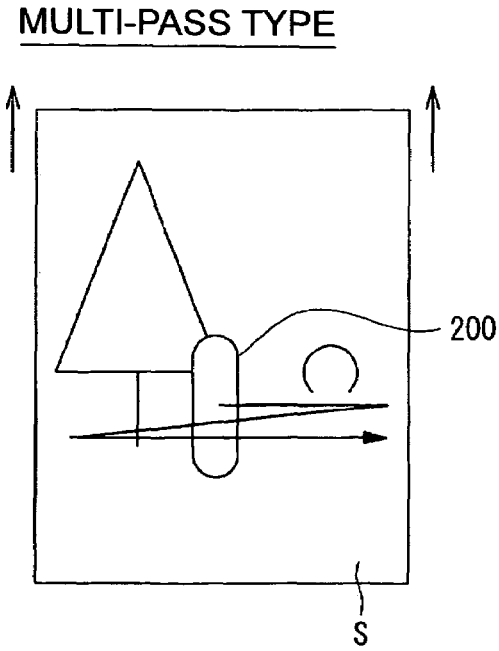
Figure 14:
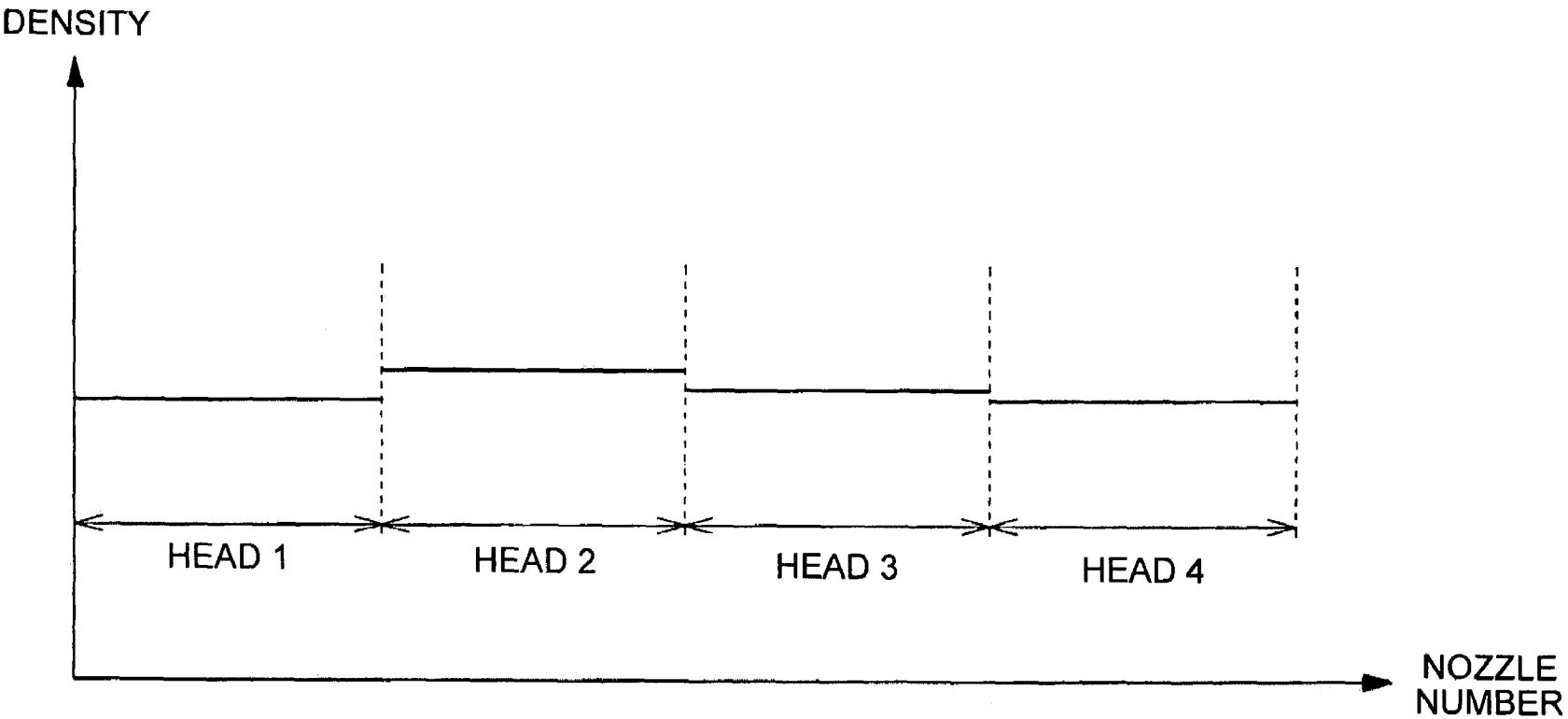
FIG. 14 shows a density change characteristic according to a conventional method.

FIGS. 13A to 13C illustrate how printing is carried out with a line head type inkjet printing device, and a multi-pass type inkjet printing device.

In FIG. 13A, the widthwise direction of the rectangular printing sheet S is set as the main scanning direction for image data, and the lengthwise direction is set as the sub scanning direction for image data. As shown in FIG. 13B, the printing head 200 in the line head type inkjet printing device has a length equal to the width of the printing sheet S, and printing is complete by so-called one pass (operation) in other words by moving the printing sheet S relative to the printing head 200 in the sub scanning direction while the printing head 200 is fixed. As in the case of a so-called flat bed type scanner, the printing head 200 may be moved in the sub scanning direction while the printing sheet S is fixed or alternatively both may be moved in opposite directions while printing is carried out. In contrast, in a multi-pass inkjet printing device, as shown in FIG. 13C, a printing head 200 having a length much smaller than the width of the sheet is positioned in the direction orthogonal to the main scanning direction, the head is reciprocated a number of times in the main scanning direction while the printing sheet S is moved on a prescribed pitch-basis in the sub scanning direction, when printing is carried out. Therefore, it takes longer for the latter multi-pass type inkjet printing device to complete printing than the former line head type inkjet printing device. Meanwhile, the multi-pass type can repeatedly position the printing head 200 in an arbitrary position, so that banding observed in printing results, especially white streaks can be addressed to some extent.

Furthermore, according to the above-described embodiment, the inkjet printing device that sprays ink to form dots for printing has been described by way of illustration, but the invention is applicable to other printing devices having a printing head with aligned printing mechanisms such as a thermal head printing device also called thermal transfer printing device or thermal printing device.

What is claimed is:

1. A printing device including a printing head having a plurality of printing elements arranged generally in a line to form an image on a medium, the printing device comprising:

an image data obtaining unit that obtains image data including pixel data corresponding to a plurality of pixels forming the image;

a correction information storage unit that stores correction information, the correction information being based on a density change of dots formed by the printing head for pixel data having the same value in the line of the printing elements, the correction information also being used for correcting density variations in the direction along the line, between dots printed by the printing elements;

a printing data producing unit that produces printing data corresponding to the image data; and a printing unit that prints the image on the medium by the printing head based on the printing data, the printing data producing unit producing printing data based on the image data and the correction information so that the density of dots, printed by the printing elements, varies continuously across adjacent printing elements along the entire line of printing elements substantially according to at least one of a linear, quadratic, and elliptical function.

2. The printing device according to claim 1, further comprising a plurality of the printing heads, wherein printing elements corresponding to pixel data having the same value are among the plurality of the printing heads, and the printing data producing unit produces such printing data so that the density of dots, printed by the printing elements of said plurality of printing heads varies substantially according to at least one of a linear, quadratic, and elliptical function.

3. A printing data producing device that produces printing data for use in a printing device including a printing head having a plurality of printing elements arranged in a line to form an image on a medium, the device comprising:

an image data obtaining unit that obtains image data including pixel data corresponding to a plurality of pixels forming the image;

a correction information storage unit that stores correction information, the correction information being based on a density change of dots formed by the printing head for pixel data having the same value in the line of the printing elements, the correction information also being used for correcting density variations in the direction along the line, between dots printed by the printing elements; and a printing data producing unit that produces printing data corresponding to the image data, the printing data producing unit producing printing data based on the image data and the correction information so that the density of dots, printed by the printing elements, varies continuously across adjacent printing elements along the entire line of printing elements substantially according to at least one of a linear, quadratic, and elliptical function.

* * * * *